US009408270B2

(12) United States Patent
Shinba

(10) Patent No.: US 9,408,270 B2
(45) Date of Patent: Aug. 2, 2016

(54) LIGHTING-ON/OFF CONTROL CIRCUIT AND LIGHTING-ON/OFF CONTROL METHOD

(71) Applicant: KYOCERA Document Solutions Inc., Osaka (JP)

(72) Inventor: Minoru Shinba, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/929,298

(22) Filed: Oct. 31, 2015

(65) Prior Publication Data

US 2016/0128152 A1 May 5, 2016

(30) Foreign Application Priority Data

Oct. 31, 2014 (JP) ..... 2014-223008

(51) Int. Cl.
*H05B 33/08* (2006.01)

(52) U.S. Cl.
CPC ..... *H05B 33/0845* (2013.01); *H05B 33/0815* (2013.01)

(58) Field of Classification Search
CPC ..... H05B 33/0815; H05B 33/0818; H05B 33/0845
USPC ..... 315/294
See application file for complete search history.

(56) References Cited

U.S. PATENT DOCUMENTS 4,535,272 A * 8/1985 Ueda ..... G09G 1/20 313/422
6,853,150 B2 * 2/2005 Clauberg ..... H05B 33/0818 315/185 R
2010/0283398 A1 * 11/2010 Sah ..... H05B 33/0815 315/210
2012/0286683 A1 * 11/2012 Radermacher ..... H05B 33/0815 315/201
2013/0009560 A1 * 1/2013 Takeda ..... H05B 33/0818 315/201
2013/0127357 A1 * 5/2013 Wu ..... H05B 41/28 315/200 R
2014/0117878 A1 * 5/2014 Prodic ..... H05B 33/0815 315/307
2015/0257223 A1 * 9/2015 Siessegger ..... H05B 33/0818 315/186

FOREIGN PATENT DOCUMENTS

JP 2005-243396 A 9/2005
JP 2011-124195 A 6/2011

* cited by examiner

*Primary Examiner* — Don Le
(74) *Attorney, Agent, or Firm* — Hawaii Patent Services; Nathaniel K. Fedde; Kenton N. Fedde

(57) ABSTRACT

Provided is a lighting-on/off control circuit that can increase number of LEDs that can go on/off, without increasing number of control signal lines. It includes a control circuit outputting plural first and second signals, a first push-pull circuit receiving plural first signals, a second push-pull circuit receiving plural second signals, and an LED group capable of being connected in between one of outputs of first push-pull circuit and one of outputs of second one. When first signal has a first value and second signal has a second value, a first current flows from first to second push-pull circuit; when second signal has a first value and first signal has a second value, a second current flows from second to first push-pull circuit.

4 Claims, 24 Drawing Sheets

FIG.5

| | CONTROL SIGNAL CNT | | | | | |
|---|---|---|---|---|---|---|
| | H | | Z | | L | |
| SELECTION SIGNAL SEL | LED9a | LED9b | LED9a | LED9b | LED9a | LED9b |
| H | 0 | 0 | 0 | 0 | 1 | 0 |
| Z | 0 | 0 | 0 | 0 | 0 | 0 |
| L | 0 | 1 | 0 | 0 | 0 | 0 |

FIG.9A

| | CONTROL SIGNAL CNTa | | | |
|---|---|---|---|---|
| | H | | L | |
| SELECTION SIGNAL SEL | LED9a | LED9b | LED9a | LED9b |
| H | 0 | 0 | 1 | 0 |
| Z | 0 | 0 | 0 | 0 |
| L | 0 | 1 | 0 | 0 |

LIGHTING-ON/OFF CONTROL CIRCUIT AND LIGHTING-ON/OFF CONTROL METHOD

INCORPORATION BY REFERENCE

This application is based on and claims the benefit of priority from Japanese Patent Application No. 2014-223008 filed on Oct. 31, 2014, the contents of which are hereby incorporated by reference.

BACKGROUND

The present disclosure relates to a light emitting device lighting-on/off control circuit in a light emitting display device in which light emitting devices, such as light emitting diodes, are arranged in a matrix.

Many of the copying machines or Multifunctional Peripherals (MFPs) (apparatuses having a combination of functions, such as those of printer, scanner, and facsimile) include a control part in which light emitting display devices (indicators) or buttons having a light emitting display function are arranged.

Generally, such a control part has a configuration in which LEDs (Light Emitting Diodes) or switches (such pushbutton switches) incorporating an LED are arranged on a control part substrate that is separated from a main control apparatus for the copying machine or the Multifunctional Peripheral (MFP).

For connection between such a control apparatus and a control part substrate, a connector or a flat cable is used, however, in order to reduce the number of signal lines, a scan matrix circuit in which a plurality of LEDs are arranged in a matrix is often formed on the control part substrate to control lighting-on/off of the LEDs.

SUMMARY

A lighting-on/off control circuit of the present disclosure includes a control circuit that outputs a plurality of first signals and a plurality of second signals, a plurality of first push-pull circuits to which each of the plurality of first signals is inputted, a plurality of second push-pull circuits to which each of the plurality of second signals is inputted, and a plurality of light emitting device groups that are capable of being connected in respective circuits between one of the outputs of the plurality of first push-pull circuits and one of the outputs of the plurality of second push-pull circuits. Upon the first signal being of a first value and the second signal being of a second value, a first current flows from the first push-pull circuit to the second push-pull circuit. Upon the second signal being of a first value and the first signal being of a second value, a second current flows from the second push-pull circuit to the first push-pull circuit. Each of the plurality of light emitting device groups is comprised of a first light emitting device that is lighted on only by the first current or a second light emitting device that is lighted on only by the second current, or the first light emitting device and the second light emitting device that are connected in parallel.

A lighting-on/off control method of the present disclosure is a lighting-on/off control method using a lighting control circuit, including: a control circuit that outputs a plurality of first signals and a plurality of second signals, a plurality of first push-pull circuits to which each of the plurality of first signals is inputted, a plurality of second push-pull circuits to which each of the plurality of second signals is inputted, and a plurality of light emitting device groups that are capable of being connected in respective circuits between one of the outputs of the plurality of first push-pull circuits and one of the outputs of the plurality of second push-pull circuits. Upon the first signal being of a first value and the second signal being of a second value, a first current flows from the first push-pull circuit to the second push-pull circuit. Upon the second signal being of a first value and the first signal being of a second value, a second current flows from the second push-pull circuit to the first push-pull circuit. Each of the plurality of light emitting device groups is lighted on by a first light emitting device that is lighted on only by the first current or a second light emitting device that is lighted on only by the second current, or the first light emitting device and the second light emitting device that are connected in parallel.

BRIEF DESCRIPTION OF THE DRAWINGS

FIG. 5 is a drawing (truth table) giving the relation between the states of the selection signal SEL and the control signal CNT in the first embodiment of the present disclosure and the lighting on/off state of the LED 9*a* and the LED 9*b;*

FIG. 9A is a truth table giving the relation between the states of the selection signal SEL and the control signal CNT in the second embodiment of the present disclosure and the lighting on/off state of the LED 9*a* and the LED 9*b;*

DETAILED DESCRIPTION

Next, embodiments of the present disclosure will be specifically explained with reference to the drawings. In the following respective drawings, the same component is provided with the same symbol.

First Embodiment

Figure 1A:
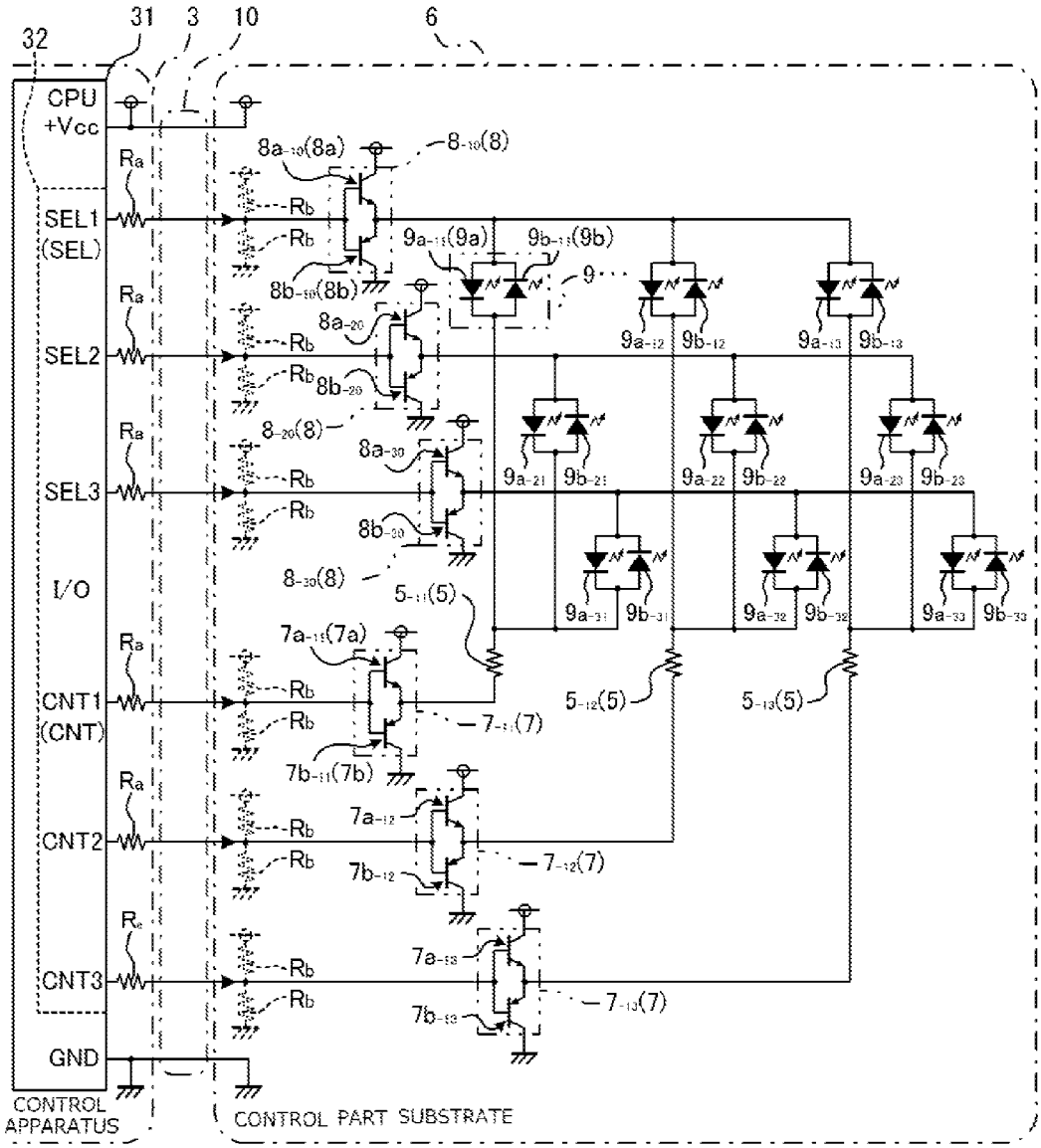
FIG. 1A is a circuit diagram illustrating an electrical configuration of a lighting-on/off control circuit according to a first embodiment of the present disclosure, and an LED 9*a* and an LED 9*b;*

FIG. 1A is a circuit diagram illustrating an electrical configuration of a lighting on/off control circuit according to a first embodiment of the present disclosure.

In the present embodiment, a control apparatus 3 and a control part substrate 6 are connected to each other by a cable 10, the control apparatus 3 having a CPU (Central Processing Unit, i.e., control circuit) 31.

The CPU 31 is supplied with +Vcc (with respect to the ground GND) as a supply voltage, being operated by a control program that is stored in a storage device (not shown), or the like.

This CPU 31 is provided with an I/O (input/output port) 32, outputting selection signals SEL1 to SEL3 (hereinafter, to be called simply as SEL as required) for scanning a plurality of LEDs (later described), and control signals CNT1 to CNT3 (hereinafter, to be called simply as CNT as required) for controlling the LEDs to light on/off.

In the present embodiment, these selection signals SEL and control signals CNT are provided with a three-state (3S, 3-value or 3-state) port, approaching a voltage of +Vcc at the time of "H", and a voltage of GND at the time of "L" (the detailed voltage value varying depending upon the type of a circuit, such as TTL or CMOS), and in addition having a high impedance (or insulation) state as "Z".

A resistor $R_a$ on the output side of the selection signal SEL and the control signal CNT in the I/O 32 comprehensively represents an output impedance at the respective signal output ends, a dumping resistor, a protection resistor, and the like, and in the present disclosure, exhibits no characteristic function, and therefore, detailed explanation thereof will be omitted.

When inputted to a control part substrate 6, the selection signal SEL1 is connected to the input side of a driver $\mathbf{8}_{-10}$.

The driver $\mathbf{8}_{-10}$ is a driver of totem pole output (totem pole connection), in which an NPN transistor $\mathbf{8}a_{-10}$, which is a bipolar transistor, and a PNP transistor $\mathbf{8}b_{-10}$, which is a bipolar transistor, (in the present embodiment, these may not be a complementary pair) form an SEPP (Single-Ended Push-Pull) circuit. The input side of this driver $\mathbf{8}_{-10}$ provides a base terminal of the NPN transistor $\mathbf{8}a_{-10}$ and a base terminal of the PNP transistor $\mathbf{8}b_{-10}$, while the output side provides an emitter terminal of the NPN transistor $\mathbf{8}a_{-10}$ and an emitter terminal of the PNP transistor $\mathbf{8}b_{-10}$. The selection signal SEL2, the selection signal SEL3, and the control signals CNT1 to CNT3 are also connected to the input side of the driver $\mathbf{8}_{-20}$, the driver $\mathbf{8}_{-30}$, and the drivers $\mathbf{7}_{-11}$ to $\mathbf{7}_{-13}$, respectively. The configuration of these drivers $\mathbf{8}_{-20}$ and $\mathbf{8}_{-30}$, and the drivers $\mathbf{7}_{-11}$ to $\mathbf{7}_{-13}$ corresponds to that of the driver $\mathbf{8}_{-10}$, and thus explanation thereof will be omitted.

Hereinafter, as required, these drivers $\mathbf{7}_{-11}$, $\mathbf{8}_{-10}$, . . . , the NPN transistors $\mathbf{7}a_{-11}$, $\mathbf{8}a_{-10}$, . . . , and the PNP transistors $\mathbf{7}b_{-11}$, $\mathbf{8}b_{-10}$, . . . will be simply called the driver 7, 8, the NPN transistor 7*a*, 8*a*, and the PNP transistor 7*b*, 8*b*. LEDs $\mathbf{9}a_{-11}$, $\mathbf{9}a_{-12}$, . . . , LEDs $\mathbf{9}b_{-11}$, $\mathbf{9}b_{-12}$, . . . , and current limiting resistors $\mathbf{5}_{11}$, . . . , which are later described, will also be simply called, as needed, an LED 9*a*, an LED 9*b*, and a current limiting resistor 5, respectively.

In addition, the configuration of the NPN transistor 7*a*, 8*a* and the PNP transistor 8*a*, 8*b*, the functions of the collector base terminal, the base terminal, and the emitter terminal of these, the details of the various parameters, and the like, are known general matters, and thus explanation thereof will be omitted.

Figure 1B:
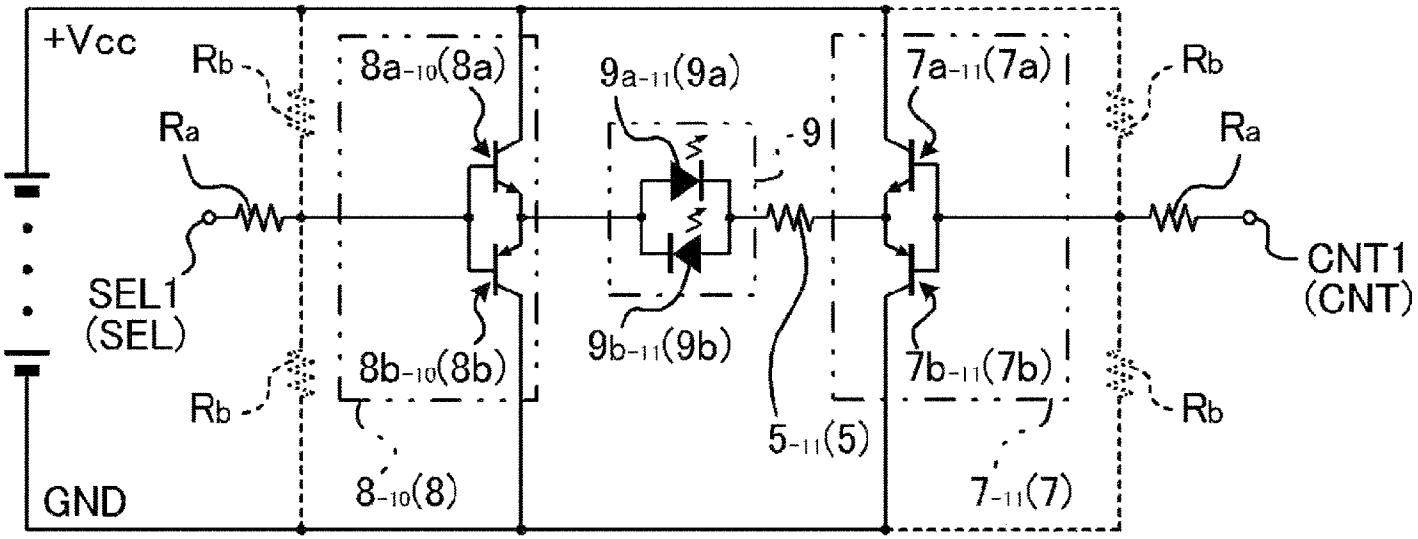
FIG. 1B is a circuit diagram illustrating the details of a combination of the LED 9*a* and the LED 9*b* with a driver 8 and the driver 7, which sandwich them.

Between the output side of the drivers $\mathbf{8}_{-10}$ to $\mathbf{8}_{-30}$ and the output side of the drivers $\mathbf{7}_{-11}$ to $\mathbf{7}_{-13}$, a matrix circuit is provided, however, as a typical example of combination, a combination of the LED $\mathbf{9}a_{-11}$ and the LED $\mathbf{9}b_{-11}$ with the driver $\mathbf{8}_{-10}$ and the driver $\mathbf{7}_{-11}$, which sandwich them, is shown in FIG. 1B for explanation. Generally, for a circuit, such as the driver 7 or the driver 8, in order to prevent the switching speed of the NPN transistor 7*a*, 8*a* and the PNP transistor 7*b*, 8*b* from being lowered, a bias resistor may be connected to the input side (the base terminal), or the internal resistance of a device that is connected to the circuit may have an effect thereon, however, in the present embodiment, it is assumed that the effect of such resistor $R_b$ need not be taken into account.

Between the emitter terminal of the NPN transistor $\mathbf{8}a_{-10}$ and the emitter terminal of the PNP transistor $\mathbf{8}b_{-10}$, which are on the output side of the driver $\mathbf{8}_{-10}$, and the emitter terminal of the NPN transistor $\mathbf{7}a_{-11}$ and the emitter terminal of the PNP transistor $\mathbf{7}b_{-11}$, which are on the output side of the driver $\mathbf{7}_{-11}$, an LED pair 9, which is comprised of the LED $\mathbf{9}a_{-11}$ and the LED $\mathbf{9}b_{-11}$, and the current limiting resistor $\mathbf{5}_{-11}$ are connected in series.

With this LED pair 9, the LED $\mathbf{9}a_{-11}$ and the LED $\mathbf{9}b_{-11}$ are connected in parallel such that each other's anode terminal and cathode terminal are oriented in opposite directions. In other words, with the LED $\mathbf{9}a_{-11}$ and the LED $\mathbf{9}b_{-11}$, the directions of current flowing through them are opposite to each other.

Thereby, on the basis of the relation between the potential on the output side of the driver $\mathbf{8}_{-10}$ and the potential on the output side of the driver $\mathbf{7}_{-11}$, either one of the LED $\mathbf{9}a_{-11}$ and the LED $\mathbf{9}b_{-11}$ is lighted on, or otherwise, both of these are not lighted on (both of these will not be simultaneously lighted on).

Figure 2A:
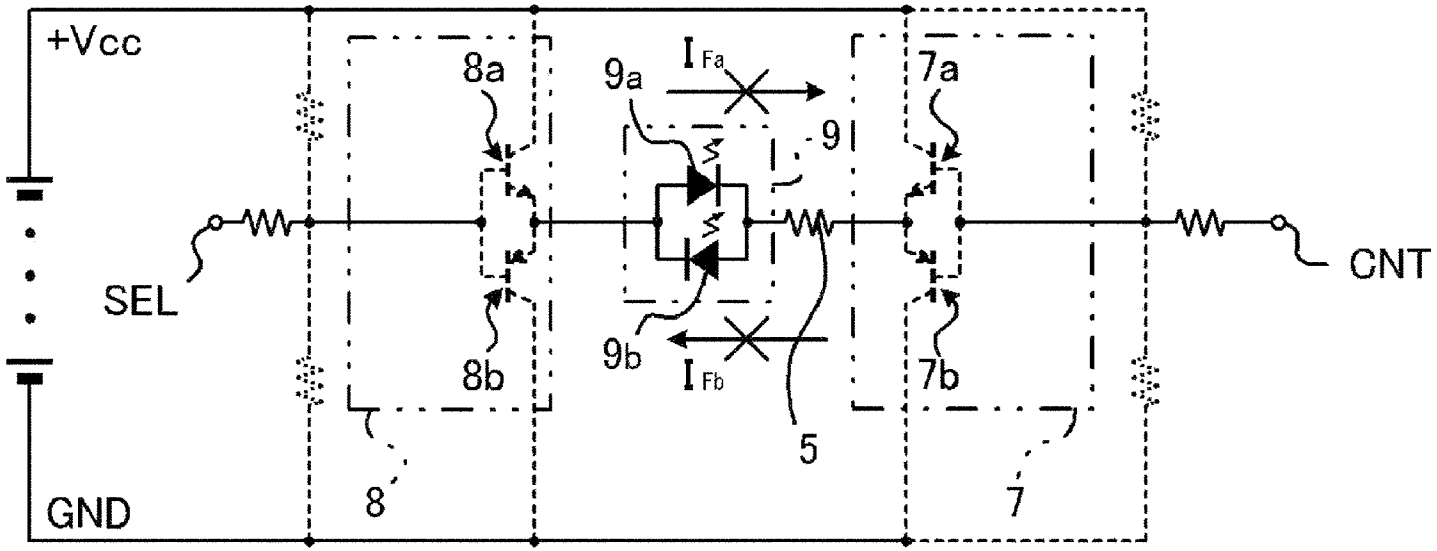
FIG. 2A is an explanatory drawing for explaining one example of operation of a circuit having a combination of the LED 9*a* and the LED 9*b* with the driver 8 and the driver 7, which sandwich them, in a first embodiment of the present disclosure.

For example, assuming that there is no effect of the resistor $R_b$, and the like, in the case where, as shown in FIG. 2A, the selection signal SEL and the control signal CNT are open (in other words, at "Z"), the NPN transistor 7*a*, 8*a* and the PNP transistor 7*b*, 8*b* are off, and thus no current flows through the LED 9*a* and the LED 9*b*, thereby either of the LED 9*a* and the LED 9*b* being not lighted on.

Figure 2B:
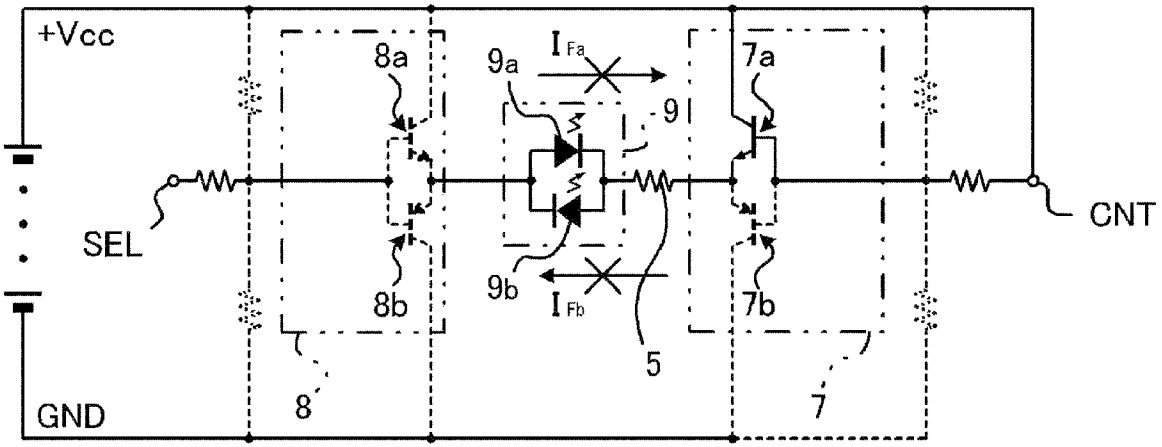
FIG. 2B is an explanatory drawing for explaining one example of operation of a circuit having a combination of the LED 9*a* and the LED 9*b* with the driver 8 and the driver 7, which sandwich them, in a first embodiment of the present disclosure.

In addition, even if, from the state in FIG. 2A, the control signal CNT is turned to "H" as shown in FIG. 2B, no base current can flow through the NPN transistor 7*a* and the PNP transistor 7*b*, thereby the NPN transistor 7*a* and the PNP transistor 7*b* being kept off. Therefore, the current ($I_{Fa}$, $I_{Fb}$)) will not flow through the LED 9*a* and the LED 9*b*, thereby either of the LED 9*a* and the LED 9*b* being not lighted on.

Figure 2C:
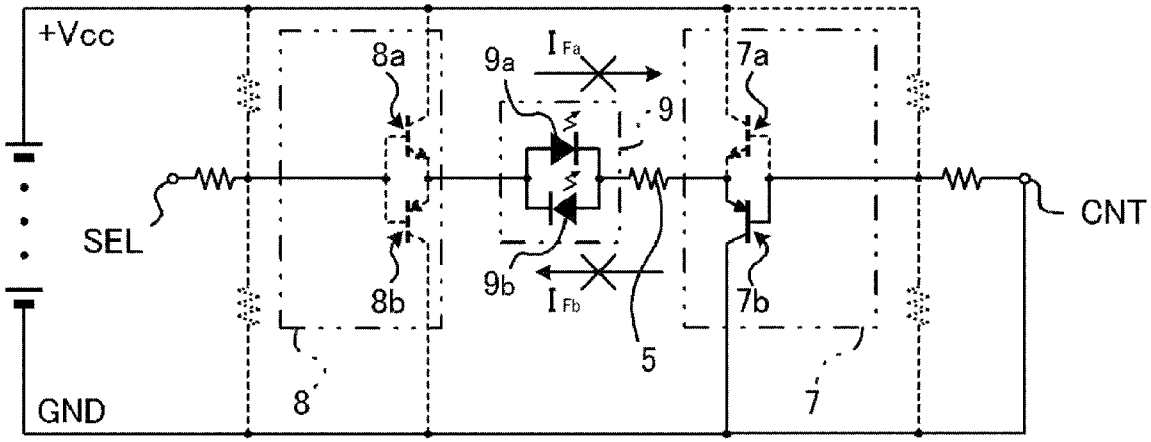
FIG. 2C is an explanatory drawing for explaining one example of operation of a circuit having a combination of the LED 9*a* and the LED 9*b* with the driver 8 and the driver 7, which sandwich them, in a first embodiment of the present disclosure.

Likewise, even if, from the state in FIG. 2A, the control signal CNT is turned to "L" as shown in FIG. 2C, no base current can flow through the NPN transistor 7*a* and the PNP transistor 7*b*, thereby the NPN transistor 7*a* and the PNP transistor 7*b* being kept turned off. Therefore, likewise, the current ($I_{Fa}$, $I_{Fb}$) will not flow through the LED 9*a* and the LED 9*b*, thereby either of the LED 9*a* and the LED 9*b* being not lighted on.

Figure 3A:
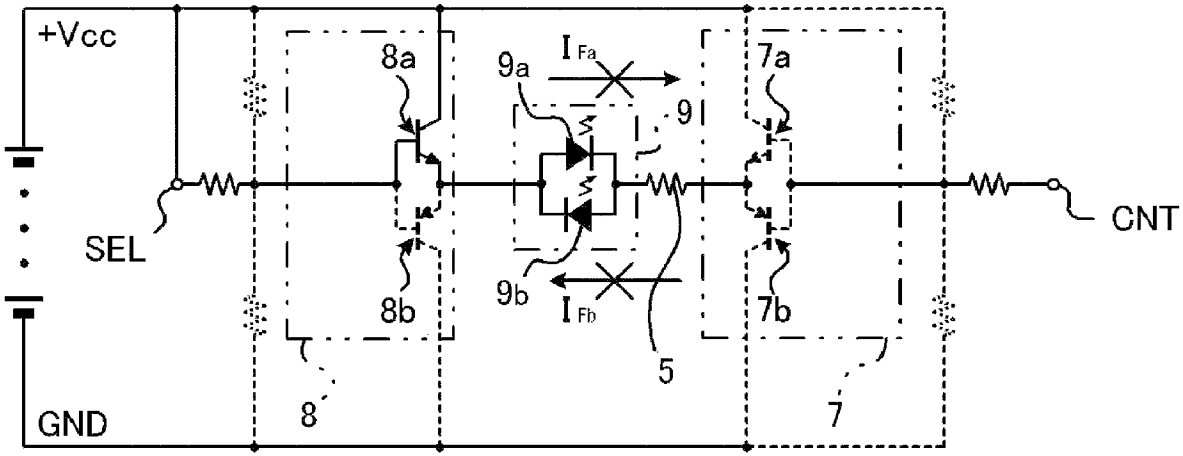
FIG. 3A is an explanatory drawing for explaining one example of operation of a circuit having a combination of the LED 9*a* and the LED 9*b* with the driver 8 and the driver 7, which sandwich them, in a first embodiment of the present disclosure.
Figure 3B:
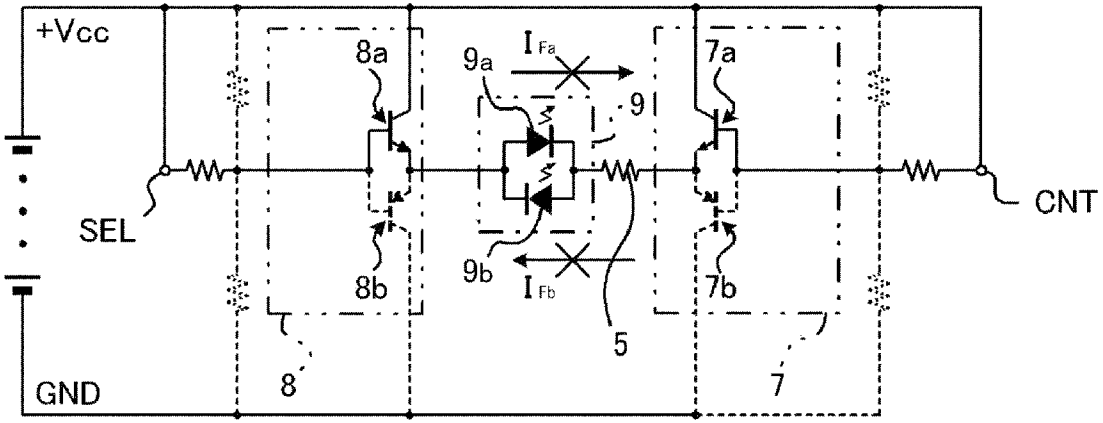
FIG. 3B is an explanatory drawing for explaining one example of operation of a circuit having a combination of the LED 9*a* and the LED 9*b* with the driver 8 and the driver 7, which sandwich them, in a first embodiment of the present disclosure.
Figure 3C:
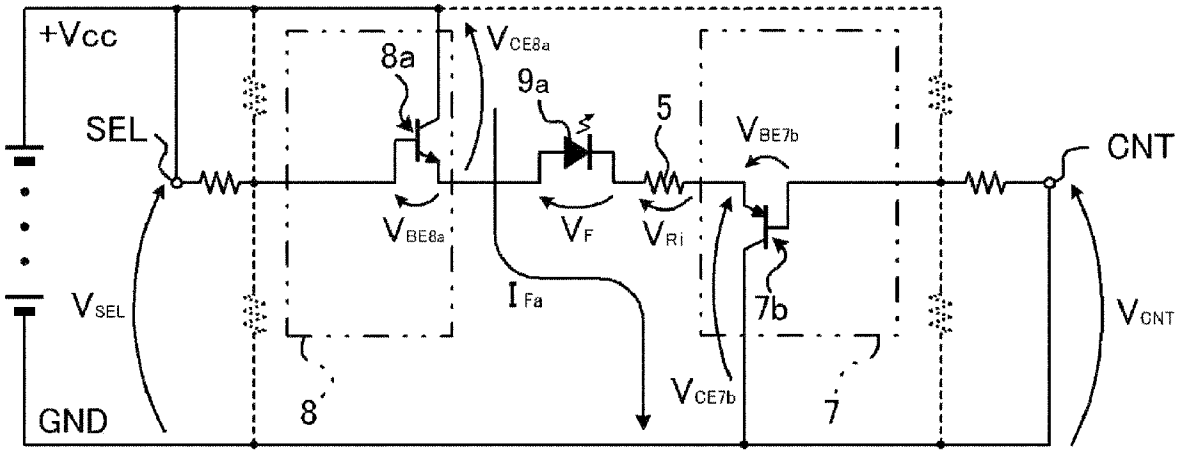
FIG. 3C is an explanatory drawing for explaining one example of operation of a circuit having a combination of the LED 9*a* and the LED 9*b* with the driver 8 and the driver 7, which sandwich them, in a first embodiment of the present disclosure.

On the one hand, FIGS. 3A to 3C show the case where the selection signal SEL is at "H" for a circuit having a combination of the LED 9*a* and the LED 9*b* with the driver 8 and the driver 7, which sandwich them.

In FIG. 3A, although the selection signal SEL is at "H", the control signal CNT is open. In this case, since the NPN transistor 7*a* and PNP transistor 7*b* are off, no base current can flow through the NPN transistor 8*a* and the PNP transistor 8*b*, thereby the NPN transistor 8*a* and the PNP transistor 8*b* being turned off. Therefore, the current ($I_{Fa}$, $I_{Fb}$) will not flow through the LED 9*a* and the LED 9*b*, thereby either of the LED 9*a* and the LED 9*b* being not lighted on.

In the case where, from the state in FIG. 3A, the control signal CNT is turned to "H" as shown in FIG. 3B, the driver 8 and the driver 7 are provided with approximately the same potential, and thus no base current can flow through either of the NPN transistor 7*a*, 8*a* and the PNP transistor 7*b*, 8*b*, thereby either of the NPN transistor 7*a*, 8*a* and the PNP transistor 7*b*, 8*b* being kept turned off. Therefore, the current ($I_{Fa}$, $I_{Fb}$) will not flow through the LED 9*a* and the LED 9*b*, thereby either of the LED 9*a* and the LED 9*b* being not lighted on.

In FIG. 3C, from the state in FIG. 3B, the control signal CNT is turned to "L". The case such as this will be explained in detail. In FIG. 3C, any device that makes no active operation is not indicated. In addition, the voltage values are indicated with a polarity with respect to the GND.

In FIG. 3C, since the selection signal SEL is at "H", the voltage $V_{SEL}$ is at a high value close to Vcc. Since the NPN transistor 8*a* is a collector grounded circuit, the voltage on the output side of the driver 8 (in other words, at the emitter terminal of the NPN transistor 8*a*) can rise to a value of ($V_{SEL}-V_{BE8a}$). This $V_{BE8a}$ is a base-to-emitter voltage of the NPN transistor 8*a*, generally being 0.6 V to 0.7 V. The voltage $V_{CE8a}$ is a collector-to-emitter voltage of the NPN transistor 8*a*, and this potential difference can be reduced to the collector-to-emitter saturation voltage $V_{CE(sat)}$ of the NPN transistor 8*a*. In addition, in FIG. 3C, since the control signal CNT is at "L", the voltage $V_{CNT}$ is at a low value close to the GND (in other words 0 V). Since the PNP transistor 7*b* is a collector grounded circuit, the voltage on the output side of the driver 7 (in other words, at the emitter terminal of the PNP transistor 7*b*) can fall to a value of ($V_{CNT}+V_{BE7b}$). This $V_{BE7b}$ is a base-to-emitter voltage of the PNP transistor 7*b*, generally being 0.6 V to 0.7 V (−0.7 V to −0.6 V with respect to the potential at the emitter terminal). The voltage $V_{CE7b}$ is a collector-to-emitter voltage of the PNP transistor 7*b*, and this potential difference can be reduced to the collector-to-emitter saturation voltage $V_{CE(sat)}$ of the PNP transistor 7*b*.

Here, when the potential difference that is generated in a direction from the emitter terminal of the PNP transistor 7*b* to the emitter terminal of the NPN transistor 8*a* exceeds the forward voltage $V_F$ (2 to 4 V) of the LED 9*a*, a forward current $I_{Fa}$ flows through the LED 9*a*, and assuming that the voltage drop due to the current limiting resistor 5 is $V_{Ri}$, the potential difference is converged into $V_{CE8a}+V_F+V_{Ri}+V_{CE7b}$=Vcc. In other words, at the time when the current $I_{Fa}$ flows through the LED 9*a*, the LED 9*a* is lighted on.

Figure 4A:
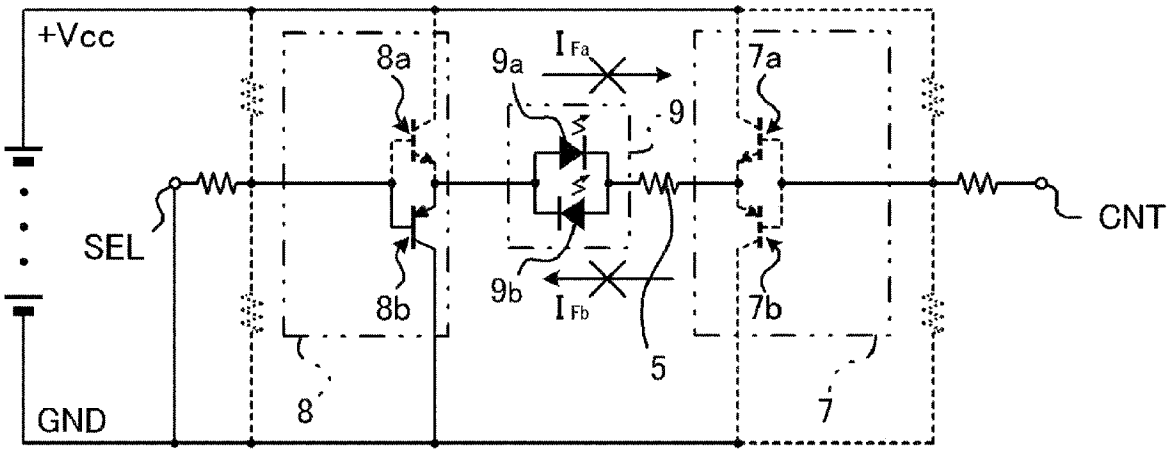
FIG. 4A is an explanatory drawing for explaining one example of operation of a circuit having a combination of the LED 9*a* and the LED 9*b* with the driver 8 and the driver 7, which sandwich them, in a first embodiment of the present disclosure.
Figure 4B:
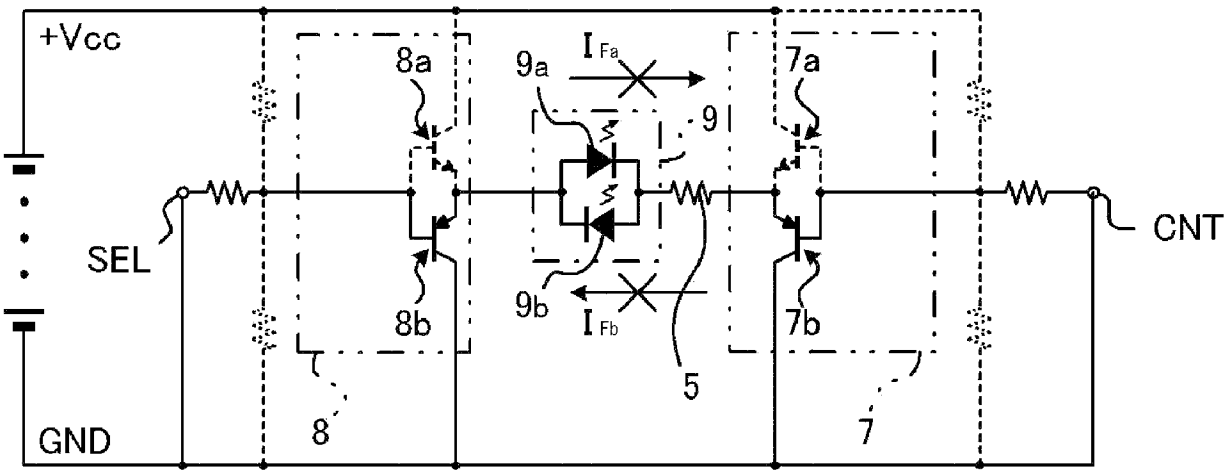
FIG. 4B is an explanatory drawing for explaining one example of operation of a circuit having a combination of the LED 9*a* and the LED 9*b* with the driver 8 and the driver 7, which sandwich them, in a first embodiment of the present disclosure.
Figure 4C:
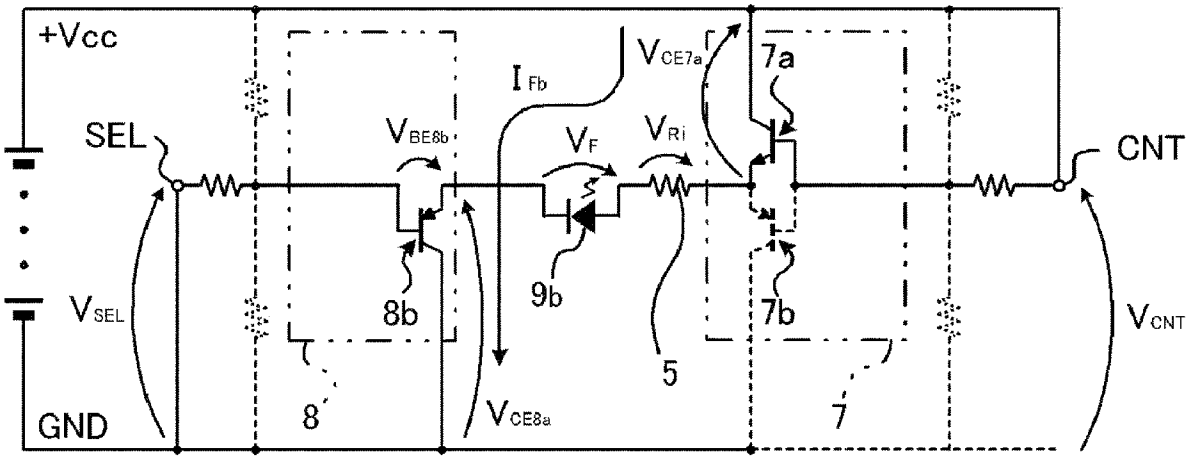
FIG. 4C is an explanatory drawing for explaining one example of operation of a circuit having a combination of the LED 9*a* and the LED 9*b* with the driver 8 and the driver 7, which sandwich them, in a first embodiment of the present disclosure.

On the other hand, FIGS. 4A to 4C show the case where the selection signal SEL is at "L" for a circuit having a combination of the LED 9*a* and the LED 9*b* with the driver 8 and the driver 7, which sandwich them.

In FIG. 4A, although the selection signal SEL is at "L", the control signal CNT is open. Therefore, the action is the same as that in FIG. 3A, the current ($I_{Fa}$, $I_{Fb}$) will not flow through the LED 9*a* and the LED 9*b*, thereby either of the LED 9*a* and the LED 9*b* being not lighted on.

In the case where, from the state in FIG. 4A, the control signal CNT is turned to "L" as shown in FIG. 4B, the driver 8 and the driver 7 are provided with approximately the same potential, and thus no base current can flow through either of the NPN transistor 7*a*, 8*a* and the PNP transistor 7*b*, 8*b*, thereby either of the NPN transistor 7*a*, 8*a* and the PNP transistor 7*b*, 8*b* being kept turned off. Therefore, the current ($I_{Fa}$, $I_{Fb}$) will not flow through the LED 9*a* and the LED 9*b*, thereby either of the LED 9*a* and the LED 9*b* being not lighted on.

In FIG. 4C, from the state in FIG. 4B, the control signal CNT is turned to "H". In this FIG. 4C, the circuit from the driver 7 to the driver 8 is symmetrical with respect to that shown in FIG. 3C, and thus a detailed explanation will be omitted. Here, when the potential difference that is generated in a direction from the emitter terminal of the PNP transistor 8*b* to the emitter terminal of the NPN transistor 7*a* exceeds the forward voltage $V_F$ (2 to 4 V) of the LED 9*b*, a forward current $I_{Fb}$ flows through the LED 9*b*, and assuming that the voltage drop due to the current limiting resistor 5 is $V_{Ri}$, the potential difference is converged into $V_{CE7a}+V_F+V_{Ri}+V_{CE8b}=Vcc$. In other words, at the time when a current $I_{Fb}$ thus flows through the LED 9*b*, the LED 9*b* is lighted on.

FIG. 5 gives the relation between such states of the selection signal SEL and the control signal CNT and the lighting on/off state of the LED 9*a* and the LED 9*b*. In FIG. 5, the symbol giving "1" in an oval frame represents that the LED 9*a* or the LED 9*b* is lighted on, while the symbol giving a void character "0" represents that the LED 9*a* or the LED 9*b* is lighted off.

Figure 6:
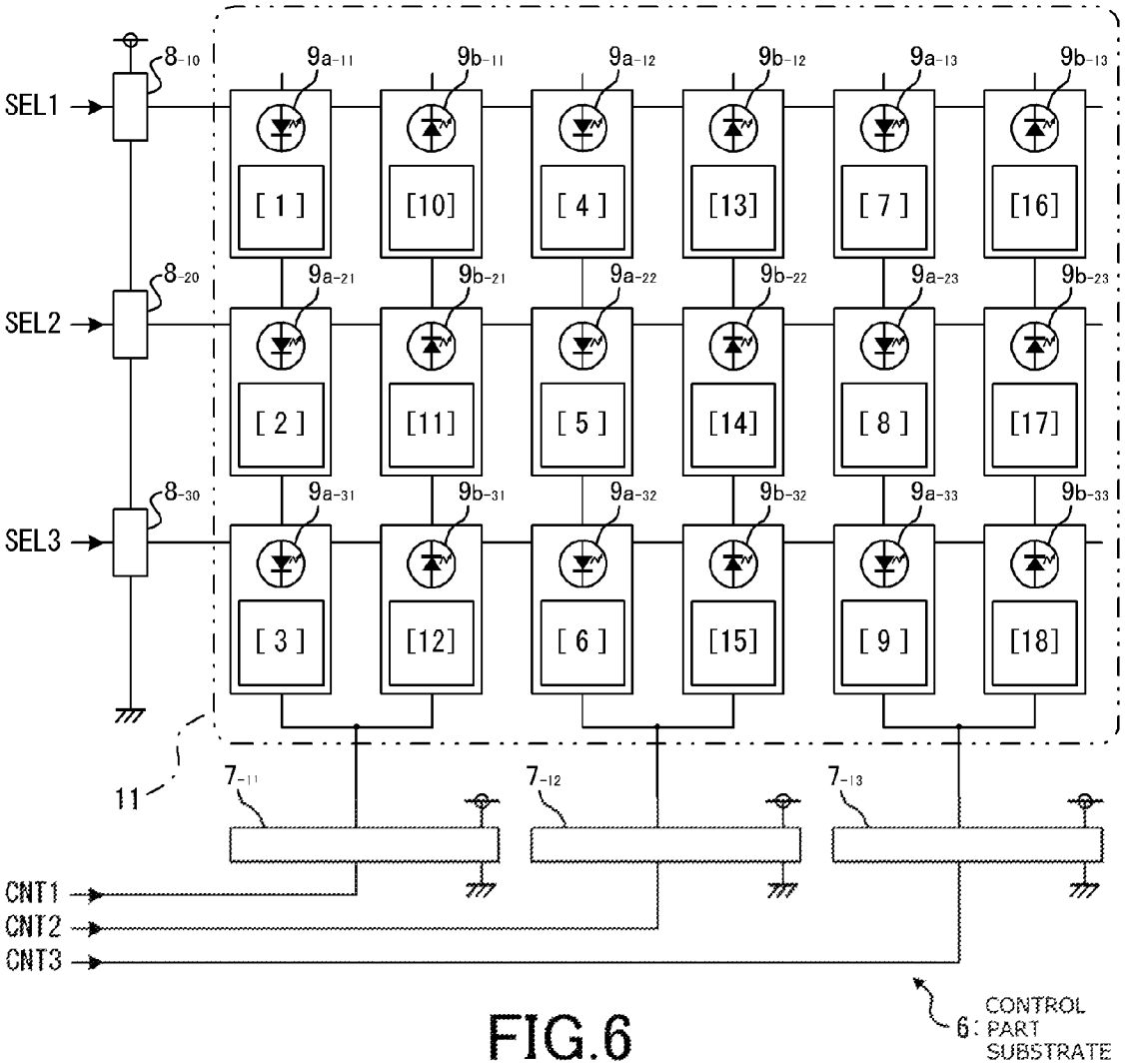
FIG. 6 is an explanatory drawing for explaining a configuration of a control part substrate 6 (a matrix circuit 11) in the first embodiment of the present disclosure, and the relative arranged positions and the numbers for the sake of convenience of the respective LEDs.

FIG. 6 shows a detailed configuration of the control part substrate 6 having a matrix circuit 11 that uses the selection signals SEL1 to SEL3 and the control signals CNT1 to CNT3 through such drivers $\mathbf{8}_{-10}$ to $\mathbf{8}_{-30}$ or drivers $\mathbf{7}_{-11}$ to $\mathbf{7}_{-13}$.

In FIG. 6, the relative arranged positions on the matrix circuit 11 of the respective LEDs $\mathbf{9}a_{-11}$, $\mathbf{9}a_{-12}$, . . . , LEDs $\mathbf{9}b_{11}$, $\mathbf{9}b_{12}$, . . . , and the numbers attached to them for the sake of convenience are indicated.

In other words, it is indicated that the LED $\mathbf{9}a_{-11}$ is connected across the selection signal SEL1 and the control signal CNT1, the number thereof being [1], while the LED $\mathbf{9}a_{-21}$ is connected across the selection signal SEL2 and the control signal CNT1, the number thereof being [2].

Further, it is indicated that the LED $\mathbf{9}b_{-11}$ is connected across the selection signal SEL1 and the control signal CNT1, the number thereof being [10]; . . . ; the LED $\mathbf{9}b_{-23}$ is connected across the selection signal SEL2 an the control signal CNT3, the number thereof being [17]; and the LED $\mathbf{9}b_{-33}$ is connected across the selection signal SEL3 and the control signal CNT3, the number thereof being [18].

Figure 7:
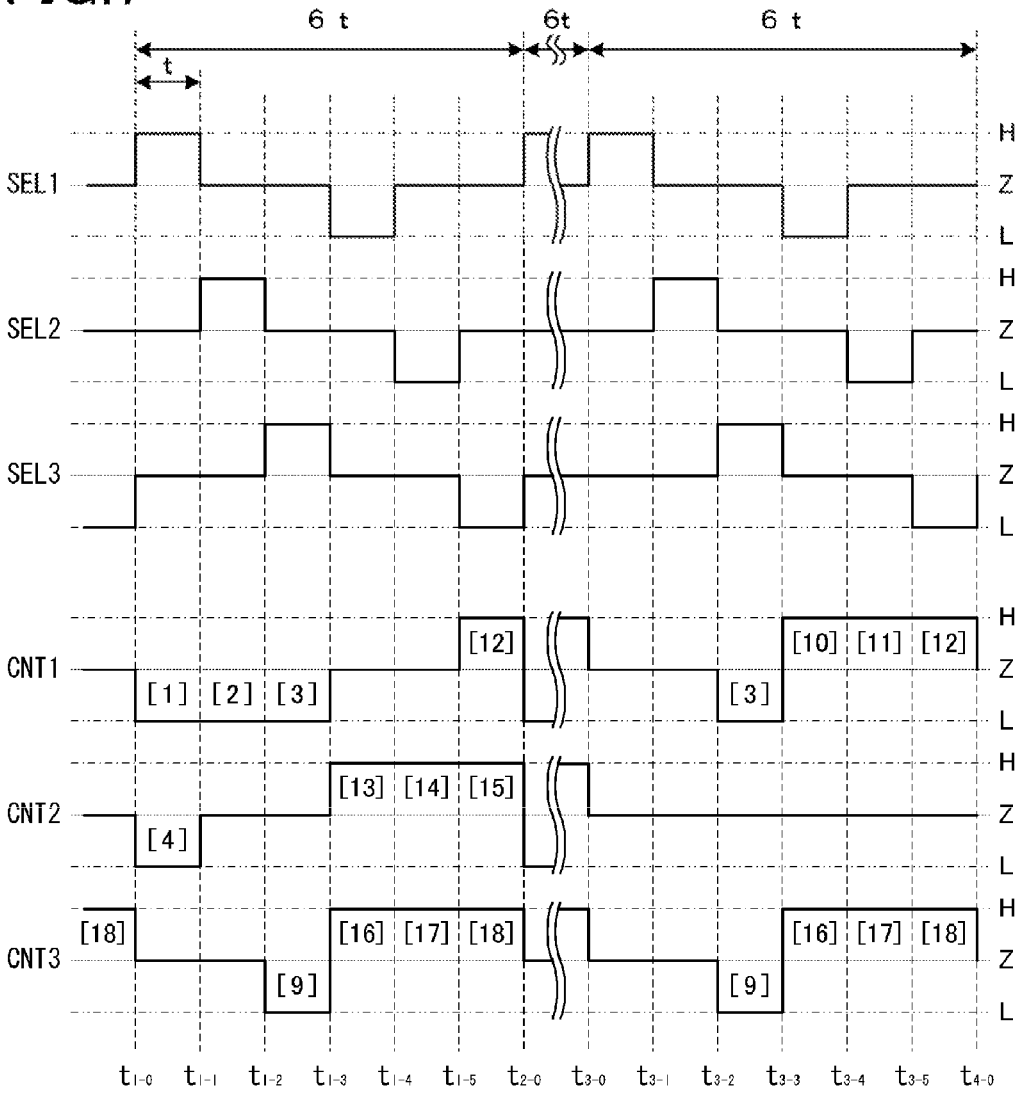
FIG. 7 is a drawing (a timing chart) showing an example of aspect of the change exhibited by the selection signals SEL1 to SEL3 and the control signals CNT1 to CNT3 in the first embodiment of the present disclosure.

Here, an example of aspect of the change exhibited by the selection signals SEL1 to SEL3 and the control signals CNT1 to CNT3 is shown in FIG. 7. In the present embodiment, the CPU 31 performs a scan operation in which only one of the selection signals SEL1 to SEL3 is selectively turned to "H" or "L", and the others excluding such one are turned to "Z" or kept at "Z".

In addition, simultaneously with the scan operation, the state of the control signals CNT1 to CNT3 corresponding to the respective LEDs 9*a* or LEDs 9*b* that are to be lighted on/off among the respective LEDs 9*a* and LEDs 9*b* is changed or kept unchanged.

Such scan operation is made for every period of time of t, and for each of the selection signals SEL1 to SEL3, there is provided a period of time of t during which it is at "H" and that during which it is at "L". Therefore, the scan operation is repeated with a time period of 6t being used as one cycle.

The value of such period of time of t varies depending upon the afterglow characteristics of the LED 9*a* and the LED 9*b*, however, in the case where scanning is performed with a time period of 6t being used as one cycle as in the present embodiment, the value of t is specified to be a value of more than a dozen milliseconds, as an example (to be such a value that one cycle of a time period of 6t provides a time period corresponding to several tens of cycles of a commercial power supply frequency, or more specifically, one cycle of a time period of 6t provides a time period corresponding to 50 to 100 cycles or so of a commercial power supply frequency).

In FIG. 7, at the time $t_{1-0}$, the CPU 31 turns the selection signal SEL1 to "H"; keeps the selection signal SEL2 at "Z"; and turns the selection signal SEL3 to "Z". In addition, at this time, the control signal CNT1 and the control signal CNT2 are turned to "L", and the control signal CNT3 is turned to "Z".

Thereby, the $LED_{9a-11}$ of the number for the sake of convenience of [1] and the $LED_{9a-12}$ of the number of [4] shown in FIG. 6 are lighted on, and the LEDs 9*a* other than these and the LEDs 9*b* are not lighted on (the LED $\mathbf{9}b_{-33}$ of the number of [18], which has been lighted on up to here, is lighted off).

Next at the time $t_{1-1}$ (see FIG. 7), the CPU 31 turns the selection signal SEL1 to "Z" from "H", and turns the selection signal SEL2 to "H" from "Z". The selection signal SEL3 is kept at "Z".

In addition, at this time $t_{1-1}$, the control signal CNT1 is kept at "L"; the control signal CNT2 is turned to "Z"; and the control signal CNT3 is kept at "Z". Thereby, the LED $\mathbf{9}a_{-21}$ of the number [2] shown in FIG. 6 is lighted on, and the LEDs 9*a* other than this and the LEDs 9*b* are not lighted on (the LED $\mathbf{9}a_{-11}$ of the number of [1] and the LED $\mathbf{9}a_{-12}$ of the number of [4], which have been lighted on up to here, are lighted off).

At the time $t_{1-2}$, the selection signal SEL1 is kept at "Z"; the selection signal SEL2 is turned to "Z"; and the selection signal SEL3 is turned to "H". In addition, the control signal CNT1 is kept at "L"; the control signal CNT3 is turned to "L"; and the control signal CNT2 is kept at "Z".

Thereby, the LED $\mathbf{9}a_{-31}$ of the number [3] and the LED $\mathbf{9}a_{-33}$ of the number [9] are lighted on, and the LEDs 9*a* other than these and the LEDs 9*b* are not lighted on (the LED $\mathbf{9}a_{-21}$ of the number of [2], which has been lighted on up to here, is lighted off).

At the next time $t_{1-3}$ (see FIG. 7), the CPU 31 turns the selection signal SEL1 to "L"; keeps the selection signal SEL2 at "Z"; and turns the selection signal SEL3 to "Z".

In addition, at this time $t_{1-3}$, the CPU 31 turns the control signal CNT1 to "Z", and turns the control signal CNT2 and the control signal CNT3 to "H". Thereby, the LED $\mathbf{9}b_{-12}$ of the number [13] and the LED $\mathbf{9}b_{-13}$ of the number [16] shown in FIG. 6 are lighted on, and the LEDs 9*a* and the LEDs 9*b* other than these are not lighted on (the LED $\mathbf{9}a_{-31}$ of the number [3] and the LED $\mathbf{9}a_{-33}$ of the number [9], which have been lighted on up to here, are lighted off).

At the time $t_{1-4}$, the selection signal SEL1 is turned from "Z" to "L", and the selection signal SEL2 is turned from "Z" to "L". The selection signal SEL3 is kept at "Z".

In addition, at this time $t_{1-4}$, the control signal CNT1 is kept at "Z", and the control signal CNT2 and the control signal CNT3 are kept at "H". Here, the LED $\mathbf{9}b_{-22}$ of the number [14] and the LED $\mathbf{9}b_{-23}$ of the number [17] shown in FIG. 6 are lighted on, and the LEDs 9*a* and the LEDs 9*b* other than these are not lighted on (the LED $\mathbf{9}b_{-12}$ of the number [13] and the LED $\mathbf{9}b_{-13}$ of the number [16], which have been lighted on up to here, are lighted off).

At the time $t_{1-5}$, the selection signal SEL2 is turned from "L" to "Z", and the selection signal SEL3 is turned from "Z" to "L". The selection signal SEL1 is kept at "Z".

In addition, at this time $t_{1-5}$, the control signal CNT1 is turned from "Z" to "H", and the control signal CNT2 and the control signal CNT3 are kept at "H". Here, the LED $\mathbf{9}b_{-31}$ of the number [12], the LED $\mathbf{9}b_{-32}$ of the number [15], and the LED $\mathbf{9}b_{-33}$ of the number [18] shown in FIG. 6 are lighted on, and the LEDs 9*a* and the LEDs 9*b* other than these are not lighted on (the LED $\mathbf{9}b_{-22}$ of the number [14] and the LED $\mathbf{9}b_{-23}$ of the number [17], which have been lighted on up to here, are lighted off).

Then, at the times $t_{2-0}$ to $t_{2-5}$, as is the case with the times $t_{1-0}$ to $t_{1-5}$, every period of time of t, the CPU 31 first turns only one of the selection signals SEL1 to SEL3 to "H" in sequence, and thereafter, only one of the selection signals SEL1 to SEL3 to "L" in sequence.

At the times $t_{2-0}$ to $t_{2-5}$, assuming that the control signals CNT1 to CNT3 are changed in the same pattern as that at the times $t_{1-0}$ to $t_{1-5}$, illustration and explanation will be omitted. In this way, with the change of the selection signals SEL1 to SEL3 and the control signals CNT1 to CNT3 being repeated in the pattern as that at the times $t_{1-0}$ to $t_{1-5}$ in FIG. 7, the LED 9*a* or LED 9*b* of the numbers [1] to [4], number [9], and numbers [12] to [18] shown in FIG. 6 appear as if they are lighted on.

At the subsequent times $t_{3-0}$ to $t_{3-5}$, since the CPU 31 changes the selection signals SEL1 to SEL3 in the same pattern as that at the times $t_{1-0}$ to $t_{1-5}$, explanation thereof will be omitted, the control signals CNT1 to CNT3 are changed as follows.

At the time $t_{3-0}$ (see FIG. 7), the CPU 31 turns any one of the control signals CNT1 to CNT3 to "Z". Thereby, the LED $9b_{-31}$ of the number [12], the LED $9b_{-32}$ of the number [15], and the LED $9b_{-33}$ of the number [18] are lighted off, and thus the LEDs 9*a* and the LEDs 9*b* are all lighted off. At the subsequent time $t_{3-1}$, the situation is the same.

At the time $t_{3-2}$, the control signal CNT1 and the control signal CNT3 are turned to "L", and the control signal CNT2 is kept at "Z".

Thereby, the LED $9a_{-31}$ of the number [3] and the LED $9a_{-33}$ of the number [9] are lighted on, and the LEDs 9*a* other than these and the LEDs 9*b* are kept lighted off.

At the subsequent time $t_{3-3}$, the CPU 31 turns the control signal CNT1 and the control signal CNT3 to "H", and keeps the control signal CNT2 at "Z".

Thereby, the LED $9b_{-11}$ of the number [10] and the LED $9b_{-13}$ of the number [16] shown in FIG. 6 are lighted on, and the LEDs 9*a* and the LEDs 9*b* other than these are not lighted on (the LED $9a_{-31}$ of the number [3] and the LED $9a_{-33}$ of the number [9], which have been lighted on up to here, are lighted off).

At the time $t_{3-4}$, although the control signal CNT1 and the control signal CNT3 are kept at "H", while the control signal CNT2 being kept at "Z", the selection signal SEL1 is turned from "L" to "Z", and the selection signal SEL2 is turned from "Z" to "L", the LED $9b_{-21}$ of the number [11] and the LED $9b_{-23}$ of the number [17] are lighted on, and the LEDs 9*a* and the LEDs 9*b* other than these are not lighted on (the LED $9b_{-11}$ of the number [10] and the LED $9b_{-13}$ of the number [16], which have been lighted on up to here, are lighted off).

At the time $t_{3-5}$, although the control signals CNT1 to CNT3 are kept unchanged, the selection signal SEL2 is turned from "L" to "Z", and the selection signal SEL3 is turned from "Z" to "L", the LED $9b_{-31}$ of the number [12] and the LED $9b_{-33}$ of the number [18] are lighted on, and the LEDs 9*a* and the LEDs 9*b* other than these are not lighted on (the LED $9b_{-21}$ of the number [11] and the LED $9b_{-23}$ of the number [17], which have been lighted on up to here, are lighted off).

In this way, with the change of the selection signals SEL1 to SEL3 and the control signals CNT1 to CNT3 in the pattern as that at the times $t_{3-0}$ to $t_{3-5}$ in FIG. 7 being repeated, the LED 9*a* or LED 9*b* of the number [3], numbers [9] to [12], and numbers [16] to [18] shown in FIG. 6 appear as if they are lighted on.

In addition, at the time of switching from repeating the pattern as that at the times $t_{1-0}$ to $t_{1-5}$ to repeating the pattern as that at the times $t_{3-0}$ to $t_{3-5}$, the number [1], number [2], number [4], and numbers [13] to [15] appear as if they are lighted off, while the numbers [10] and [11] appearing as if they are newly lighted on.

As described above, the present embodiment provides a scan matrix circuit comprised of three selection signal lines and three control signal lines (3×3 lines), and thus with the typical technique, the number of LEDs that can be controlled to be lighted on/off would be 3×3=9. With the present disclosure, up to 18 LEDs can be controlled to be lighted on/off, compared to the number of LEDs that can be controlled to be lighted on/off with the typical technique (which would require 3+6=9 or 4+5=9 signal lines).

By the way, with reference to FIG. 5, it can be seen that, besides the combinations of a selection signal SEL and a control signal CNT in which either the selection signal SEL or the control signal CNT is "Z", there are combinations in which either of the LED 9*a* and the LED 9*b* is not lighted on.

This means that, even if either one of the selection signal SEL and the control signal CNT is an output of a port giving only the two values of "H" and "L", the present disclosure allows lighting on/off of the LED 9*a* and the LED 9*b* to be controlled individually. With this point being taken into consideration, a second embodiment will be explained hereinbelow.

Second Embodiment

Figure 8A:
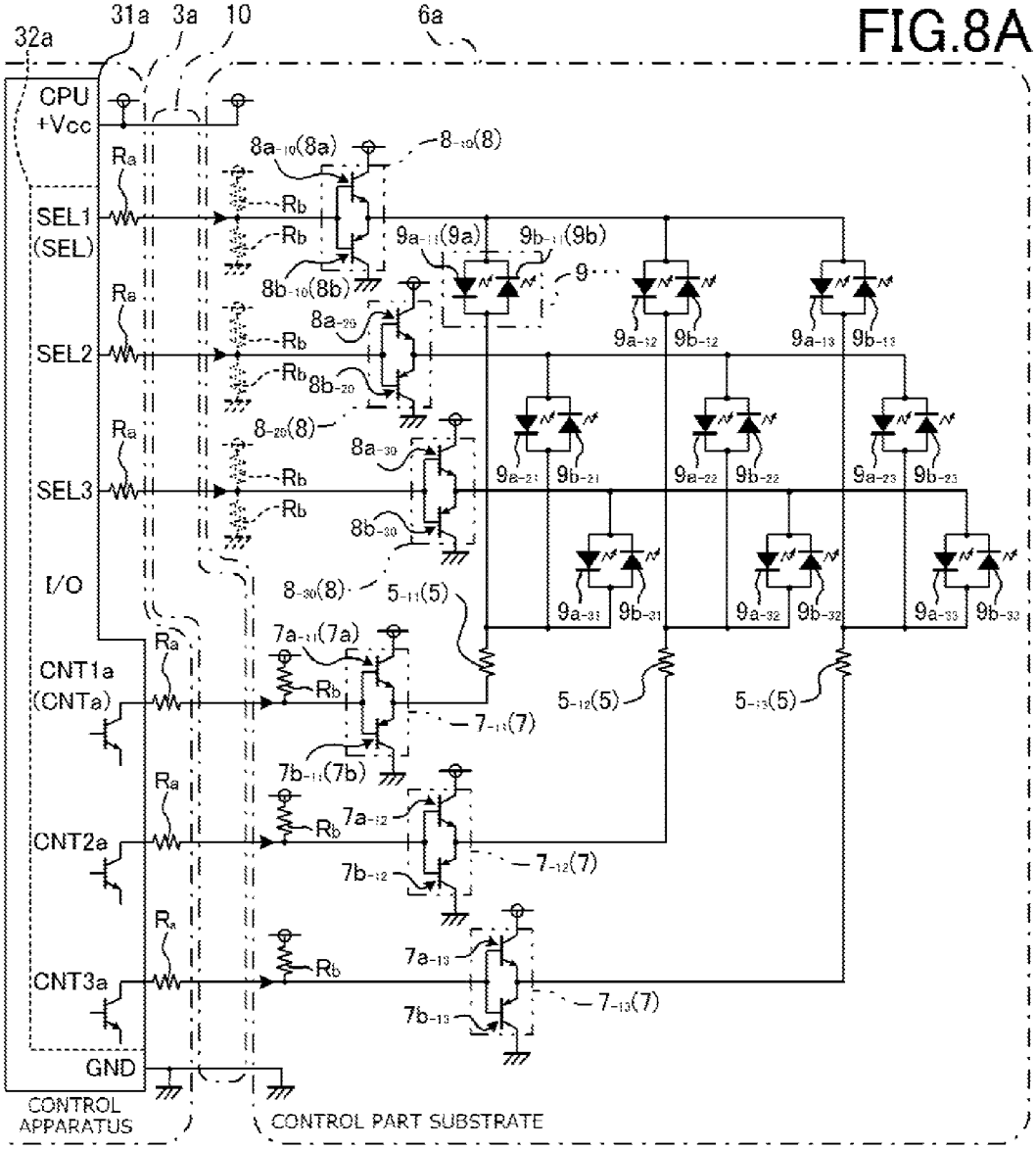
FIG. 8A is a circuit diagram illustrating an electrical configuration of a lighting-on/off control circuit according to a second embodiment of the present disclosure.
Figure 8B:
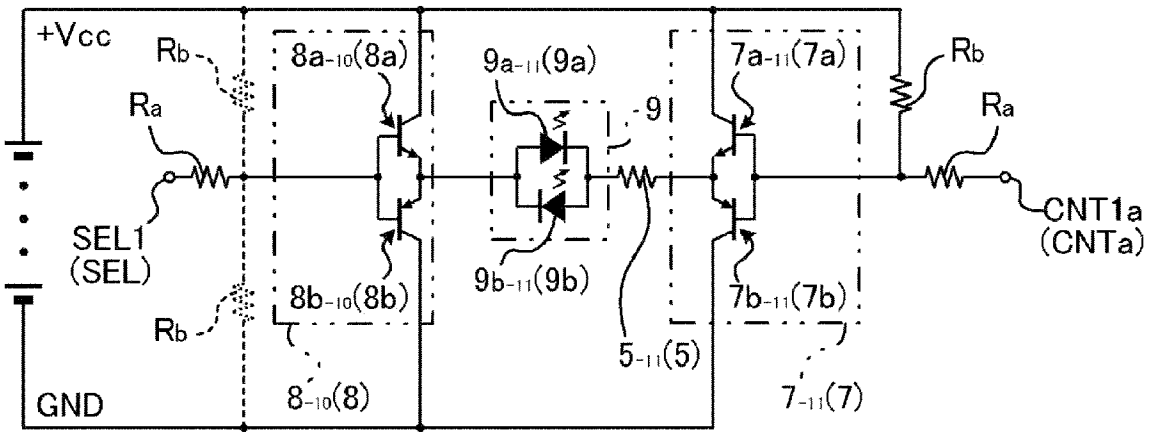
FIG. 8B is a circuit diagram illustrating the details of a combination of the LED 9*a* and the LED 9*b* with the driver 8 and the driver 7, which sandwich them.

FIG. 8A shows an electrical configuration according to a second embodiment of the present disclosure, and FIG. 8B shows the details of one example of a combination of the LED 9*a* and the LED 9*b* with the driver 8 and the driver 7, which sandwich them, in FIG. 8A. In this second embodiment, a control apparatus 3*a* and a control part substrate 6*a* are connected to each other by a cable 10, the control apparatus 3*a* having a CPU 31*a*.

The CPU 31*a* is supplied with +Vcc (with respect to the ground GND) as a supply voltage, being operated by a control program that is stored in a storage device (not shown), or the like.

This CPU 31*a* is provided with an I/O (input/output port) 32*a*, outputting selection signals SEL1 to SEL3 for scanning a plurality of LEDs 9*a*, . . . , 9*b*, . . . , and control signals CNT1*a* to CNT3*a* (hereinafter, to be called simply as CNTa as required) for controlling lighting on/off of the LEDs.

In this second embodiment, the selection signal SEL is provided with a three-state port, while the control signal CNTa is provided with a two-value port, which can give only the "H" and "L". In other words, either one of the selection signal SEL and the control signal CNTa can utilize the port or the signal lines in the typical scan matrix circuit.

With the configuration shown in FIG. 8A, the control signal CNTa is provided with an open collector port (an open drain port in the case where the output stage is a field effect transistor), a resistor $R_b$ is mandatory for pull-up on the input side of the driver 7 constituting the control part substrate 6*a*.

In FIG. 8A and FIG. 8B, since the components other than those for the control signal CNTa are the same as those shown in FIG. 1A or FIG. 1B, explanation of the components other than the characteristic portions of the second embodiment will be omitted.

In addition, in the present embodiment, the relative positions on the matrix circuit 11 of the respective LEDs $9a_{-11}$, $9a_{-12}$, . . . , LEDs $9b_{-11}$, $9b_{-12}$, . . . , and the numbers attached to them for the sake of convenience are the same as those in the whole constitution of the control part substrate 6 shown in FIG. 6, and thus for the control part substrate 6*a*, illustration of the whole constitution and detailed explanation thereof will be omitted.

FIG. 9A gives the relation between the states of the selection signal SEL and the control signal CNTa and the lighting on/off state of the LED 9*a* and the LED 9*b* in the present embodiment. Also in FIG. 9A, the symbol giving "1" in an oval frame represents that the LED 9*a* or LED 9*b* is lighted on, while the symbol giving a void character "0" represents that the LED 9*a* or LED 9*b* is lighted off.

Figure 9B:
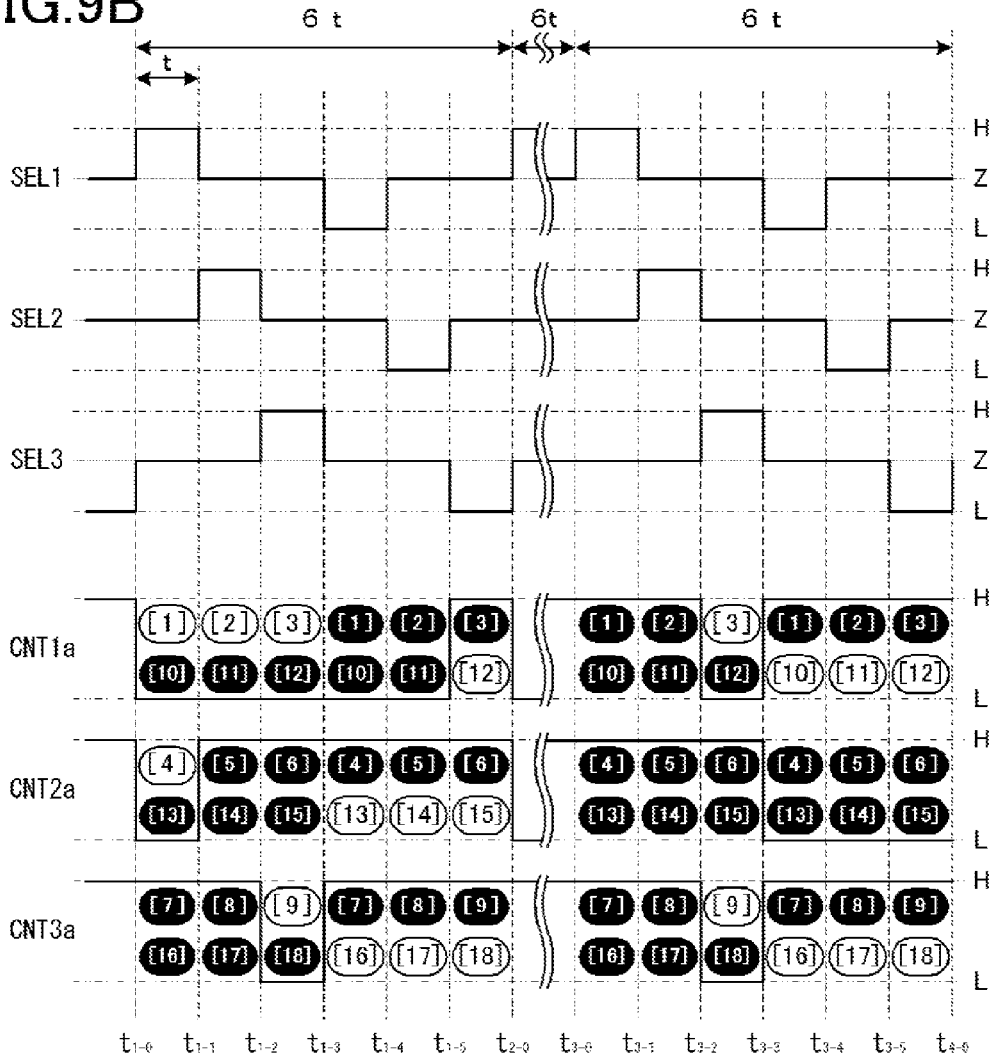
FIG. 9B is a timing chart showing an example of aspect of the change exhibited by the selection signals SEL1 to SEL3 and the control signals CNT1*a* to CNT3*a* in the second embodiment of the present disclosure.

In addition, an example of aspect of the change exhibited by the selection signals SEL1 to SEL3 and the control signals CNT1*a* to CNT3*a* is shown in FIG. FIG. 9B.

Also in the present embodiment, the CPU 31*a* performs a scan operation in which only one of the selection signals SEL1 to SEL3 is selectively turned to "H" or "L" for every period of time of t, and the state of the control signals CNT1*a* to CNT3*a* corresponding to the respective LEDs 9*a* or LEDs 9*b* that are to be lighted on/off among the respective LEDs 9*a* and LEDs 9*b* is changed or kept unchanged.

In the boxes for each of the control signals CNT1*a* to CNT3*a* in FIG. 9B, the number for the sake of convenience (see FIG. 6) of a particular LED that is provided as an object of control by that control signal CNTa during a particular period of time of t is indicated. In addition, the number of an LED that is lighted on is placed in an oval frame, while the number of an LED that is lighted off is indicated with a void character.

For example, at the time $t_{1-0}$ in FIG. 9B, the CPU 31*a* turns the selection signal SEL1 to "H"; keeps the selection signal SEL2 at "Z"; and turns the selection signal SEL3 to "Z".

With reference to FIG. 9B, when the selection signal SEL1 is "H" or "L", the control signal CNT1*a* is provided with the LED 9*a* of the number [1] and the LED 9*b* of the number [10] as objects of control (the upper row giving the number of the LED 9*a*, while the lower row the number of the LED 9*b*), with the control signal CNT1*a* being turned to "L" at the time $t_{1-0}$.

Here, with reference to FIG. 9A, it can be seen that, with a combination of SEL:H with CNTa:L, the LED 9*a* is lighted on, and the LED 9*b* is lighted off. Therefore, at the time $t_{1-0}$, the LED $\mathbf{9}a_{-11}$ of the number [1] is lighted on, and the LED $\mathbf{9}b_{-11}$ of the number [10] is lighted off.

At the time $t_{1-1}$, the selection signal SEL2 is turned to "H"; the selection signal SEL1 is turned to "Z"; and the selection signal SEL3 is kept at "Z". With reference to FIG. 9B, when the selection signal SEL2 is "H" or "L", the control signal CNT2*a* is provided with the LED 9*a* of the number [5] and the LED 9*b* of the number [14] as objects of control, with the control signal CNT2*a* being turned to "H" at the time $t_{1-1}$.

Here, with reference to FIG. 9A, it can be seen that, with a combination of SEL:H with CNTa:H, both the LED 9*a* and the LED 9*b* are lighted off. Therefore, at the time $t_{1-1}$, both of the LED $\mathbf{9}a_{-22}$ of the number [5] and the LED $\mathbf{9}b_{-22}$ of the number [14] are lighted off.

After the time has elapsed further, at the time $t_{1-5}$, the selection signal SEL3 is turned to "L"; the selection signal SEL1 is kept at "Z"; and the selection signal SEL2 is turned to "Z". With reference to FIG. 9B, when the selection signal SEL3 is "H" or "L", the control signal CNT3*a* is provided with the LED 9*a* of the number [9] and the LED 9*b* of the number [18] as objects of control, with the control signal CNT3*a* being kept at "H" at the time $t_{1-5}$.

Here, with reference to FIG. 9A, it can be seen that, with a combination of SEL:L with CNTa:H, the LED 9*a* is lighted off, and the LED 9*b* is lighted on. Therefore, at the time $t_{1-5}$, the LED $\mathbf{9}a_{-33}$ of the number [9] is lighted off, and the LED $\mathbf{9}b_{-33}$ of the number [18] is lighted on.

In this second embodiment, only one of the selection signals SEL1 to SEL3 is selectively turned to from "Z" to "H" or "L" to provide a control object selection signal SEL. At this time, such that the lighting on/off state of the LED one terminal of which is connected to the control object selection signal SEL (in other words, the LED that is provided as an object of control) matches the truth table in FIG. 9A, the state of the control signal CNTa that is connected to the other terminal of this LED is changed (to either "H" or "L").

Thus, the present disclosure is applicable even to a circuit configuration in which the control signal CNTa can provide only the two values of "H" and "L".

As described above, according to the respective embodiments of the present disclosure, by forming a matrix circuit in which, at each of the intersecting points of the output end of a plurality of push-pull circuits that drive the selection signals for scanning the LEDs and the output end of a plurality of push-pull circuits that drive the control signals for controlling lighting on/off of the LEDs, there is disposed an LED pair in which two LEDs are connected in parallel such that each other's anode is connected to each other's cathode to thereby make the direction of the current flowing through one LED opposite to that through the other LED, either one of the two LEDs constituting the LED pair can be selectively lighted on/off. Thereby, without the need for increasing the number of selection signals or the number of control signal lines, the number of LEDs that can be controlled to be lighted on/off can be increased.

The present disclosure is not limited to the above respective embodiments, and in addition, it is obvious that the respective embodiments can be appropriately altered within the scope of the technical concept of the present disclosure.

For example, in each of the above-described embodiments, as a driver for driving the LED, bipolar transistors are used to form a push-pull circuit, however, for example, FETs (Field Effect Transistors) may be used to form a push-pull circuit.

In addition, with the LED, the value of current necessitated for obtaining a sufficient brightness may often greatly vary, depending upon the luminous color tone. In the present disclosure, LEDs having different color tones may be connected in parallel such that each other's anode terminal is opposed to each other's cathode terminal, however, in that case, there may arise the need for changing the current, depending upon the color tone.

Figure 10:
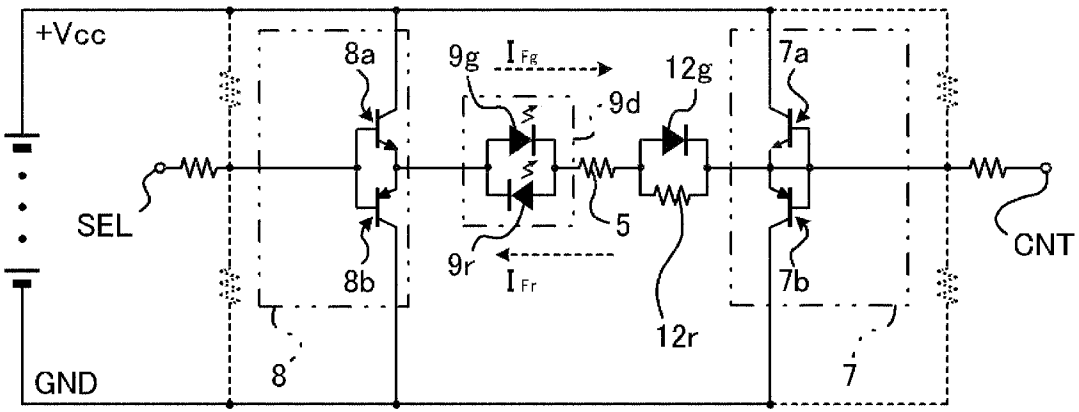
FIG. 10 is a drawing showing an application of the combination of the LED 9*a* and the LED 9*b* with the driver 8 and the driver 7, which sandwich them, according to the present disclosure.

Then, the combination of the LED 9*a* and the LED 9*b* with the driver 8 and the driver 7, which sandwich them, may be provided with a configuration shown in FIG. 10.

In the configuration shown in FIG. 10, between the emitter terminal of the NPN transistor 8*a* and the emitter terminal of the PNP transistor 8*b*, which are on the output side of the driver 8, and the emitter terminal of the NPN transistor 7*a* and the emitter terminal of the PNP transistor 7*b*, which are on the output side of the driver 7, an LED pair 9*d* comprised of an LED 9*g* and an LED 9*r*, a current limiting resistor 5, and a pair of a diode 12*g* and a current limiting resistor 12*r*, which are connected in parallel, are connected in series.

With this LED pair 9*d*, the LED 9*g* and the LED 9*r* are connected in parallel such that the direction of the current flowing through the LED 9*g* is opposite to that through the LED 9*r*, each other's anode terminal and cathode terminal being connected. In addition, the forward direction of current for the diode 12*g* is the same as the forward direction for the LED 9*g* (in other words, the direction of the current $I_{Fg}$).

In this way, when the direction of current is $I_{Fg}$, the current limiting resistor 12*r* is seemingly short-circuited (the forward voltage for the diode 12*g* being neglected), the value of the current $I_{Fg}$ becoming larger than the value of the current $I_{Fr}$.

Therefore, in the case where LEDs that are different from each other in color tone are to be connected in parallel, an LED that requires a larger current than is required by the LED 9*r* is used as the LED 9*g* (for example, a green LED being used as the LED 9*g*, while, as the LED 9*r*, a red one being used), whereby the brightnesses of both can be matched to each other.

Further, the light emitting device is not limited to the LED, and provided that the light emitting device is that which can be used by the scan matrix circuit for dynamic display, the present disclosure is applicable to any light emitting device.

In this case, if the light emitting devices used are those having no polarity, connecting a reverse-flow prevention diode in series with each light emitting device to provide a parallel configuration in which each other's direction of current is opposite will bring such light emitting devices into the scope of the present disclosure.

Figure 14A:
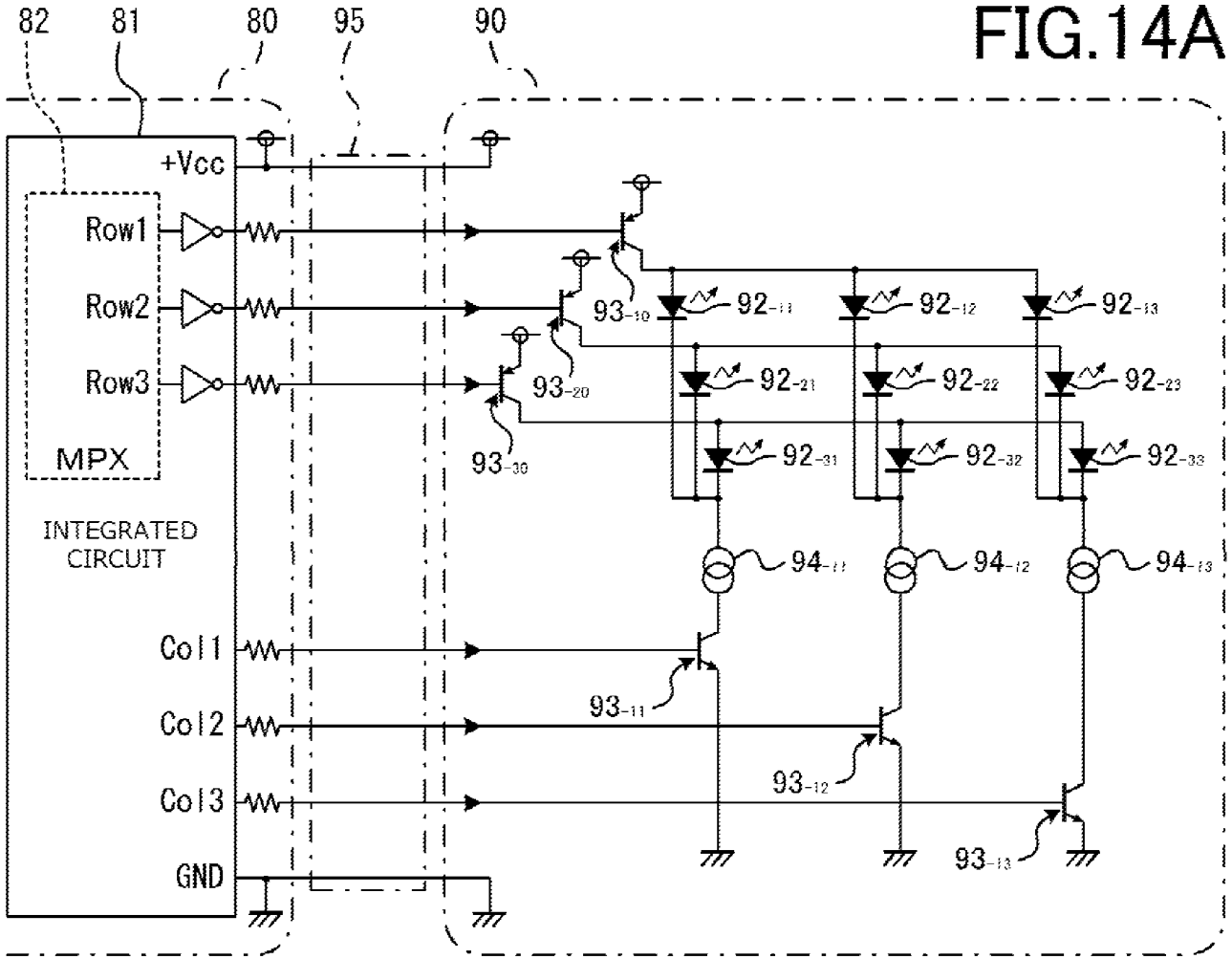
FIG. 14A is a drawing showing an example of a scan matrix circuit using LEDs.
Figure 14B:
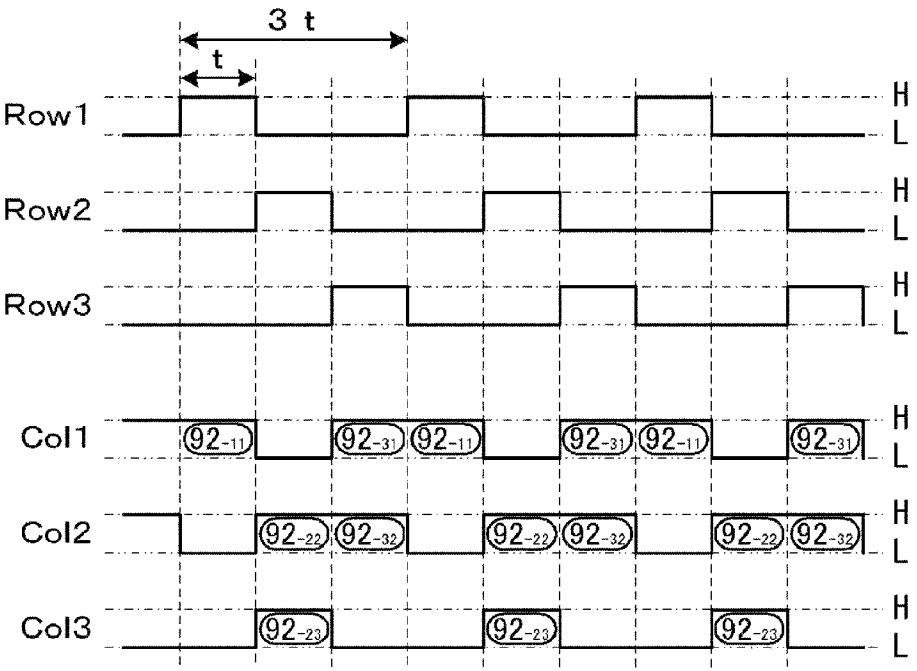
FIG. 14B is a drawing (timing chart) showing an example of aspect of the change of the signals in the scan matrix circuit using LEDs.

In the present disclosure, if all the LEDs in the matrix circuit 11 are rendered to be a pair of an LED 9*a* and an LED 9*b*, the time period for the scan cycle is doubled as long as the original one (see FIG. 7 and FIG. 14B). If the scan cycle is lengthened like this, there may be the possibility that other problems, such as conspicuous flickering of the LED, may occur.

Figure 11:
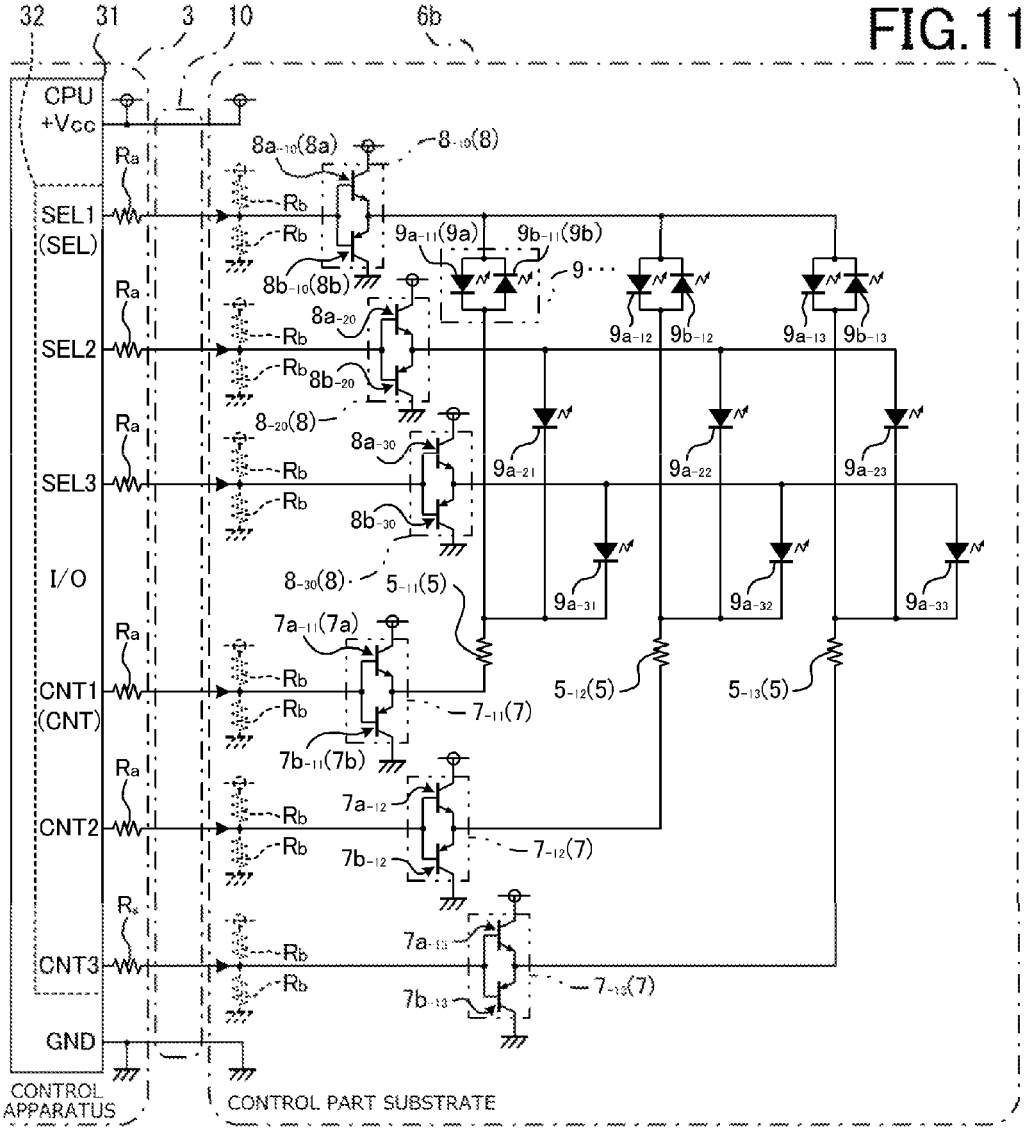
FIG. 11 is a circuit diagram illustrating the details of an electrical configuration of a lighting-on/off control circuit according to another embodiment of the present disclosure, and a combination of the LED 9*a* and the LED 9*b* with the driver 8 and the driver 7, which sandwich them.

Then, for example, as shown in FIG. 11, there may be provided a configuration in which, only for the portion where the number of LEDs can be increased, the LED is rendered to be a pair of an LED 9*a* and an LED 9*b*.

In an example shown in FIG. 11, only for the portion where the selection signal SEL1 is combined with the control signals CNT1 to CNT3, an LED pair 9 is configured, and for the other portions, only the LED 9*a* is provided.

Figure 12:
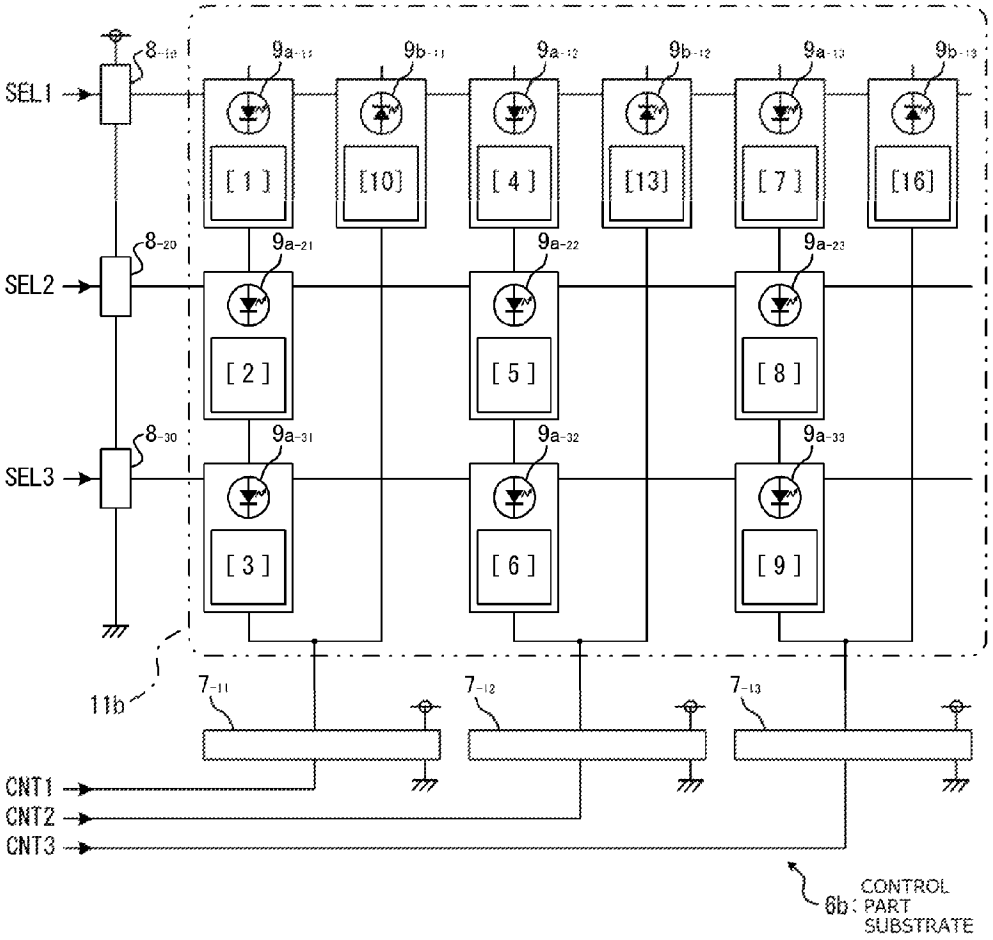
FIG. 12 is an explanatory drawing for explaining the configuration of a control part substrate 6*b* (a matrix circuit 11*b*) in the another embodiment of the present disclosure, and the relative arranged positions and the numbers for the sake of convenience of the respective LEDs.

FIG. 12 shows an example of detailed configuration of a control part substrate 6*b*. The configuration within a matrix circuit 11*b* shown in this FIG. 12 corresponds to that shown in FIG. 6, however, in the configuration shown in FIG. 11, there exist no LEDs 9*b* of the number [11], number [12], number [14], number [15], number [17], and further number [18].

Figure 13:
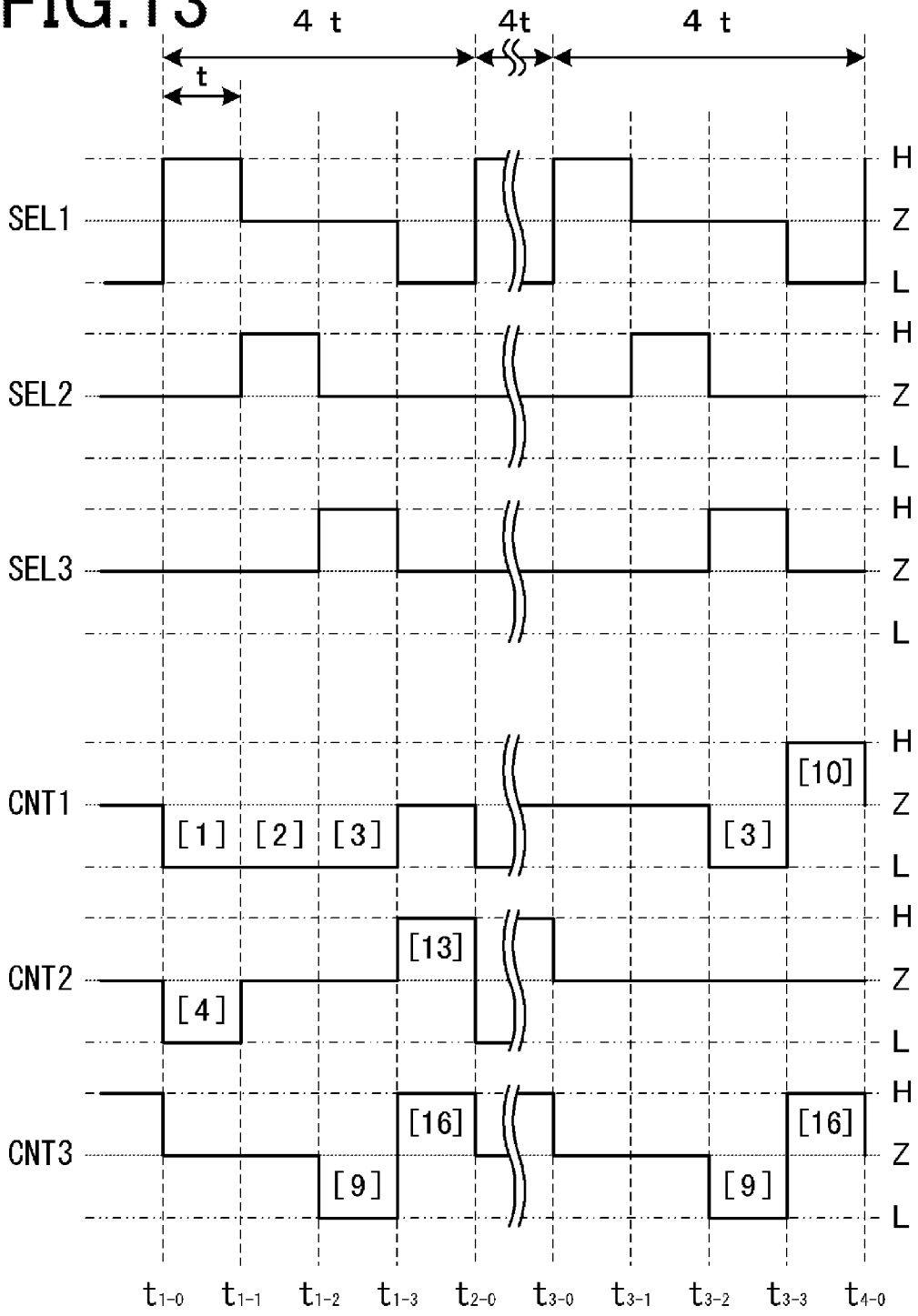
FIG. 13 is a drawing (timing chart) showing an example of aspect of the change exhibited by the selection signals SEL1 to SEL3 and the control signals CNT1 to CNT3 in the another embodiment of the present disclosure.

An example of aspect of the change exhibited by the selection signals SEL1 to SEL3 and the control signals CNT1 to CNT3 in the configuration shown in this FIG. 11 is shown in FIG. 13.

According to FIG. 13, with the configuration shown in FIG. 11, the scan cycle is repeated without the selection signal SEL2 and the selection signal SEL3 being turned to "L" (since, to the selection signal SEL2 and the selection signal SEL3, no configuration equivalent to the LED 9*b* is connected, the timing for turning them to "L" is skipped).

In other words, simply by setting the one cycle for scanning at a period of time of 4t, the lighting on/off of twelve LEDs in total can be controlled. Such a configuration is also included within the scope of the present disclosure.

With the configuration as described above, the following advantages will be obtained.

FIGS. 14A and 14B show an example of typical case of controlling lighting on/off of the LEDs arranged on a scan matrix circuit. In FIG. 14A, a matrix circuit having 3 rows×3 columns is configured, allowing a maximum of nine LEDs to be controlled to light on/off.

As shown in FIG. 14A, lighting-on/off control of the LEDs is performed by an integrated circuit 81 that is provided in a control apparatus 80. Row signals Row1 to Row3 and column signals Col1 to Col3 that are outputted by the integrated circuit 81 are sent to a control part substrate 90 that is connected by a cable 95.

The row signals Row1 to Row3 are outputted through an MPX (multiplexer, i.e., a switching device) 82, only one of the row signals Row1 to Row3 being selectively turned to "H (high level)", while the other two being at "L (low level)".

These row signals Row1 to Row3 are supplied to the matrix circuit through a transistor (buffer) $\mathbf{93}_{-10}$, $\mathbf{93}_{-20}$, $\mathbf{93}_{-30}$, respectively, while the column signals Col1 to Col3 being supplied to the matrix circuit through a transistor $\mathbf{93}_{-11}$, $\mathbf{93}_{-12}$, $\mathbf{93}_{-13}$, respectively. In this matrix circuit, for example, the row signal Row1 is connected to the anode of an LED $\mathbf{92}_{-11}$; the row signal Row2 is connected to the anode of an LED $\mathbf{92}_{-21}$; and the row signal Row3 is connected to the anode of an LED $\mathbf{92}_{-31}$. The respective cathodes of the LED $\mathbf{92}_{-11}$, LED $\mathbf{92}_{-21}$, and LED $\mathbf{92}_{-31}$ are connected to a single line, being connected to a transistor $\mathbf{93}_{-11}$ through a constant current circuit (or a current limiting circuit) $\mathbf{94}_{-11}$.

To the row signal Row1, the anode of an LED $\mathbf{92}_{-12}$ and the anode of an LED $\mathbf{92}_{-13}$ in addition to the anode of the LED $\mathbf{92}_{-11}$ are connected, the cathode of the LED $\mathbf{92}_{-12}$ being connected to a transistor $\mathbf{93}_{-12}$ through a constant current circuit $\mathbf{94}_{-12}$, and the cathode of the LED $\mathbf{92}_{-13}$ being connected to a transistor $\mathbf{93}_{-13}$ through a constant current circuit $\mathbf{94}_{-13}$. Likewise, the row signal Row2 is connected to the anode of an LED $\mathbf{92}_{-22}$ and the anode of an LED $\mathbf{92}_{-23}$, the cathode of the LED $\mathbf{92}_{-22}$ being connected to a transistor $\mathbf{93}_{-12}$ through a constant current circuit $\mathbf{94}_{-12}$, and the cathode of the LED $\mathbf{92}_{-23}$ being connected to a transistor $\mathbf{93}_{-13}$ through a constant current circuit $\mathbf{94}_{-13}$.

Further, likewise, the row signal Row3 is connected to the anode of an LED $\mathbf{92}_{-32}$ and the anode of an LED $\mathbf{92}_{-33}$, the cathode of the LED $\mathbf{92}_{-32}$ being connected to the transistor $\mathbf{93}_{-12}$ through the constant current circuit $\mathbf{94}_{-12}$, and the cathode of the LED $\mathbf{92}_{-33}$ being connected to the transistor $\mathbf{93}_{-13}$ through the constant current circuit $\mathbf{94}_{-13}$.

FIG. 14B shows a timing chart for the respective row signals and column signals and the lighting on/off state of the respective LEDs in FIG. 14A.

With the configuration shown in FIG. 14A, the states of the respective row signals Row1 to Row3 are changed in sequence every period of time of t (the scanning being performed with a cycle of time period of 3t), while the states of the respective column signals Col1 to Col3 can be arbitrarily changed.

In other words, each of the LED $\mathbf{92}_{-11}$ to LED $\mathbf{92}_{-13}$, LED $\mathbf{92}_{-21}$ to LED $\mathbf{92}_{-23}$, and LED $\mathbf{92}_{-31}$ to LED $\mathbf{92}_{-33}$ is lighted on when any one of the row signals Row1 to Row3 on the anode side and any one of the column signals Col1 to Col3 on the cathode are both turned to "H". In FIG. 14B, the LED ($\mathbf{92}_{-11}$ to $\mathbf{92}_{-33}$) that is lighted on is indicated by enclosing the symbol thereof with an oval frame.

In the configuration shown in FIG. 14A, the LEDs $\mathbf{92}_{-11}$ to $\mathbf{92}_{-33}$ are provided, of course, as a light source for information display. Such LED is lower in power consumption (in other words, less in heat generation), having a longer service life, and in addition, exhibiting a faster response in lighting-on/off control, thereby the number of examples of application having been rapidly increased.

However, the LED as a light source has characteristics different from those of the conventional filament, and presents problems. Some techniques provide a solution to such problems that are presented by the LED.

In the case where the LED is used as a light source for illumination, a plurality of LED devices are often arranged in order to increase the illuminance (the brightness). In a typical case, there is offered a technique that reduces the load of a power supply to the LED or enhances the safety.

In addition, many LEDs provide a monotonous wavelength (in other words, a simple color tone), and in addition, the wavelength also greatly varies from unit to unit. Therefore, a plurality of LEDs that are different in wavelength are often simultaneously lighted on in order to achieve a color tone that could not be obtained with an LED as a single body. In addition, in another typical case, there is offered a method that uses a plurality of LEDs to simply achieve a color tone that would be difficult to be obtained with a single LED.

However, in the case where such LED is used as a light source for information display or where the illuminance or color tone is to be finely controlled, there has been problems that the number of control signal lines is increased, and the degree of freedom in making a physical design of an apparatus that uses such LED as alight source is impaired. In addition, with apparatuses that have a construction in which a control signal line is wired between substrates or units, there has been a problem that an increase in the number of control signal lines may not only raise the production cost, but also increase the number of failure factors or the man-hours for maintenance.

The present disclosure has been made in view of such problems, and is intended to provide a lighting-on/off control circuit with which the number of LEDs that can be controlled to be lighted on/off can be increased without the need for increasing the number of selection signals or the number of control signal lines.

According to the present disclosure, by forming a matrix circuit in which, at each of the intersecting points of the output ends of a plurality of push-pull circuits that drive the selection signals for scanning the LEDs and the output ends of a plurality of push-pull circuits that drive the control signals for controlling lighting on/off of the LEDs, there is disposed an LED pair in which two LEDs are connected in parallel such that each other's anode is opposed to each other's cathode, thereby either one of the two LEDs constituting the LED pair can be selectively lighted on/off. Thereby, there is provided an advantage that, without the need for increasing the number of selection signals or the number of control signal lines, the number of LEDs that can be controlled to be lighted on/off can be increased.

What is claimed is:

1. A lighting control circuit comprising:

a control circuit that outputs a plurality of first signals and a plurality of second signals;

a plurality of first push-pull circuits to which each of said plurality of first signals is inputted;

a plurality of second push-pull circuits to which each of said plurality of second signals is inputted; and a plurality of light emitting device groups that are capable of being connected to respective circuits between one of the outputs of said plurality of first push-pull circuits and one of the outputs of said plurality of second push-pull circuits, when said first signal is of a first value and said second signal is of a second value, a first current flows from said first push-pull circuit to said second push-pull circuit, when said second signal is of a first value and said first signal is of a second value, a second current flows from said second push-pull circuit to said first push-pull circuit, each of said plurality of light emitting device groups including:

a first light emitting device that is lit up only by said first current or a second light emitting device that is lit up only by said second current, or said first light emitting device and said second light emitting device that are connected in parallel.

2. The lighting control circuit according to claim 1, wherein said control circuit alternately repeats a first cycle in which only one of said plurality of first signals is taken in sequence as said first value, and a second cycle in which only one of said plurality of first signals is taken in sequence as said second value.

3. The lighting control circuit according to claim 1, wherein said control circuit is capable of taking at least each of said plurality of first signals as a third value in which either of said first current and said second current will not flow.

4. A lighting control method using a lighting control circuit, comprising:

a control circuit that outputs a plurality of first signals and a plurality of second signals;

a plurality of first push-pull circuits to which each of said plurality of first signals is inputted;

a plurality of second push-pull circuits to which each of said plurality of second signals is inputted, and a plurality of light emitting device groups that are capable of being connected to respective circuits between one of the outputs of said plurality of first push-pull circuits and one of the outputs of said plurality of second push-pull circuits, when said first signal is of a first value and said second signal is of a second value, a first current flows from said first push-pull circuit to said second push-pull circuit, when said second signal is of a first value and said first signal is of a second value, a second current flows from said second push-pull circuit to said first push-pull circuit, and each of said plurality of light emitting device groups is lit up by a first light emitting device that is lit up only by said first current or a second light emitting device that is lit up only by said second current, or said first light emitting device and said second light emitting device that are connected in parallel.

* * * * *